US010876368B2

(12) United States Patent
Le

(10) Patent No.: US 10,876,368 B2
(45) Date of Patent: Dec. 29, 2020

(54) INSTALLATION AND RETRIEVAL OF PRESSURE CONTROL DEVICE RELEASABLE ASSEMBLY

(71) Applicant: WEATHERFORD TECHNOLOGY HOLDINGS, LLC, Houston, TX (US)

(72) Inventor: Tuong T. Le, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 111 days.

(21) Appl. No.: 15/378,213

(22) Filed: Dec. 14, 2016

(65) Prior Publication Data

US 2018/0163493 A1 Jun. 14, 2018

(51) Int. Cl.

| | |
|---|---|
| ***E21B 23/01*** | (2006.01) |
| ***E21B 23/02*** | (2006.01) |
| ***E21B 23/03*** | (2006.01) |
| ***E21B 33/038*** | (2006.01) |

(52) U.S. Cl.

CPC ..... *E21B 33/038* (2013.01); *E21B 23/01* (2013.01); *E21B 23/02* (2013.01); *E21B 23/03* (2013.01)

(58) Field of Classification Search

CPC ..... E21B 33/0415; E21B 33/04; E21B 23/01; E21B 23/02; E21B 23/03

See application file for complete search history.

(56) References Cited

U.S. PATENT DOCUMENTS

| | | | | |
|---|---|---|---|---|
| 4,295,528 A | | 10/1981 | Carmody | |
| 4,353,420 A | | 10/1982 | Miller | |
| 4,488,596 A | | 12/1984 | Akkerman | |
| 4,590,995 A | | 5/1986 | Evans | |
| 4,811,784 A | | 3/1989 | Theiss | |
| 4,836,278 A | | 6/1989 | Stone et al. | |
| 5,066,060 A | | 11/1991 | Cooksey et al. | |
| 5,069,288 A | | 12/1991 | Singeetham | |
| 5,404,955 A | | 4/1995 | Echols, III et al. | |
| 5,735,344 A | * | 4/1998 | Duncan | E21B 33/04 166/115 |
| 5,775,433 A | * | 7/1998 | Hammett | E21B 17/06 166/381 |

(Continued)

OTHER PUBLICATIONS

International Search Report with Written Opinion dated Mar. 28, 2018 for PCT Patent Application No. PCT/US2017/065510, 16 pages.

(Continued)

*Primary Examiner* — Cathleen R Hutchins
(74) *Attorney, Agent, or Firm* — Smith IP Services, P.C.

(57) ABSTRACT

A well system can include a pressure control device including a releasable assembly, and a running tool including a lock mechanism operable in response to a change in a fluid flow rate through the running tool. A method of retrieving a releasable assembly of a pressure control device can include engaging a running tool with a latch, applying a force from the running tool to deactivate the latch, and changing a fluid flow rate through the running tool. A pressure control device can include a releasable assembly having a passage, and a latch releasably securing the releasable assembly in an outer housing, the latch including a piston having set and unset positions, and the piston being displaceable toward the unset position in response to pressure applied to a port in the outer housing, or in response to displacement of a profile disposed in the passage.

19 Claims, 38 Drawing Sheets

(56) References Cited

U.S. PATENT DOCUMENTS

| | | | | |
|---|---|---|---|---|
| 6,827,148 | B2 * | 12/2004 | Shaw | E21B 10/322 166/255.1 |
| 7,096,956 | B2 | 8/2006 | Reimert | |
| 7,159,669 | B2 | 1/2007 | Bourgoyne et al. | |
| 8,136,588 | B2 | 3/2012 | Mason | |
| 8,322,432 | B2 | 12/2012 | Bailey et al. | |
| 9,784,073 | B2 | 10/2017 | Bailey et al. | |
| 9,845,650 | B2 | 12/2017 | Evans et al. | |
| 9,957,759 | B2 | 5/2018 | Robichaux | |
| 10,287,838 | B2 | 5/2019 | Van Bilderbeek et al. | |
| 2003/0106712 | A1 | 6/2003 | Bourgoyne et al. | |
| 2008/0210471 | A1 | 9/2008 | Bailey et al. | |
| 2010/0126776 | A1 | 5/2010 | Trevino et al. | |
| 2010/0175882 | A1 | 7/2010 | Bailey et al. | |
| 2012/0013133 | A1 | 1/2012 | Rios, III et al. | |
| 2014/0014353 | A1 | 1/2014 | Rios, III | |
| 2014/0202710 | A1 | 7/2014 | Hales et al. | |
| 2015/0136393 | A1 | 5/2015 | Turley et al. | |
| 2015/0136394 | A1 | 5/2015 | Turley et al. | |
| 2015/0136407 | A1 | 5/2015 | Bailey et al. | |
| 2015/0345256 | A1 | 12/2015 | Tulloch | |
| 2016/0076329 | A1 | 3/2016 | Nguyen et al. | |
| 2016/0222748 | A1 * | 8/2016 | Van Bilderbeek | E21B 23/04 |
| 2016/0348450 | A1 | 12/2016 | Robichaux et al. | |
| 2017/0044858 | A1 | 2/2017 | Evans et al. | |
| 2017/0114602 | A1 | 4/2017 | Grace | |
| 2018/0163493 | A1 | 6/2018 | Le | |
| 2018/0163494 | A1 | 6/2018 | Le | |
| 2019/0112886 | A1 | 4/2019 | Le | |
| 2019/0112897 | A1 | 4/2019 | Le | |

OTHER PUBLICATIONS

International Search Report with Written Opinion dated Mar. 28, 2018 for PCT Patent Application No. PCT/US2017/065512, 17 pages.

Weatherford; "Bearing Assembly, Running Tool 6-5/8 FH, Running Tool 7800/7875", drawing No. D000414120, dated Jun. 2, 2008, 1 page.

Weatherford; "Assembly, Weldment SRD Joint AGR Chevron", drawing No. D000459938, dated Jul. 15, 2011, 1 page.

Specification and drawings for U.S. Appl. No. 15/252,499, filed Aug. 31, 2016, 69 pages.

Office Action dated Aug. 28, 2018 for U.S. Appl. No. 15/378,267, 22 pages.

International Search Report with Written Opinion dated Jan. 24, 2019 for PCT Patent Application PCT/US2018/053483, 12 pages.

Office Action dated Feb. 1, 2019 for U.S. Appl. No. 15/378,267, 12 pages.

Office Action dated May 29, 2019 for U.S. Appl. No. 15/783,884, 41 pages.

Office Action dated Sep. 24, 2019 for U.S. Appl. No. 15/783,884, 10 pages.

* cited by examiner

INSTALLATION AND RETRIEVAL OF PRESSURE CONTROL DEVICE RELEASABLE ASSEMBLY

BACKGROUND

This disclosure relates generally to equipment utilized and operations performed in conjunction with a subterranean well and, in an example described below, more particularly provides a pressure control device, and tools for installation and retrieval of a releasable assembly of the pressure control device.

A pressure control device is typically used to seal off an annular space between an outer tubular structure (such as, a riser, a housing on a subsea structure in a riser-less system, or a housing attached to a surface wellhead) and an inner tubular (such as, a drill string, a test string, etc.). At times it may be desired for components (such as, bearings, seals, etc.) of the pressure control device to be retrieved from, or installed in, an outer housing (such as, a riser housing).

Therefore, it will be appreciated that advancements are continually needed in the arts of constructing and operating pressure control devices. In particular, it would be desirable to provide for convenient and efficient installation and retrieval of pressure control device components respectively into and out of an outer housing.

DETAILED DESCRIPTION

Figure 1:
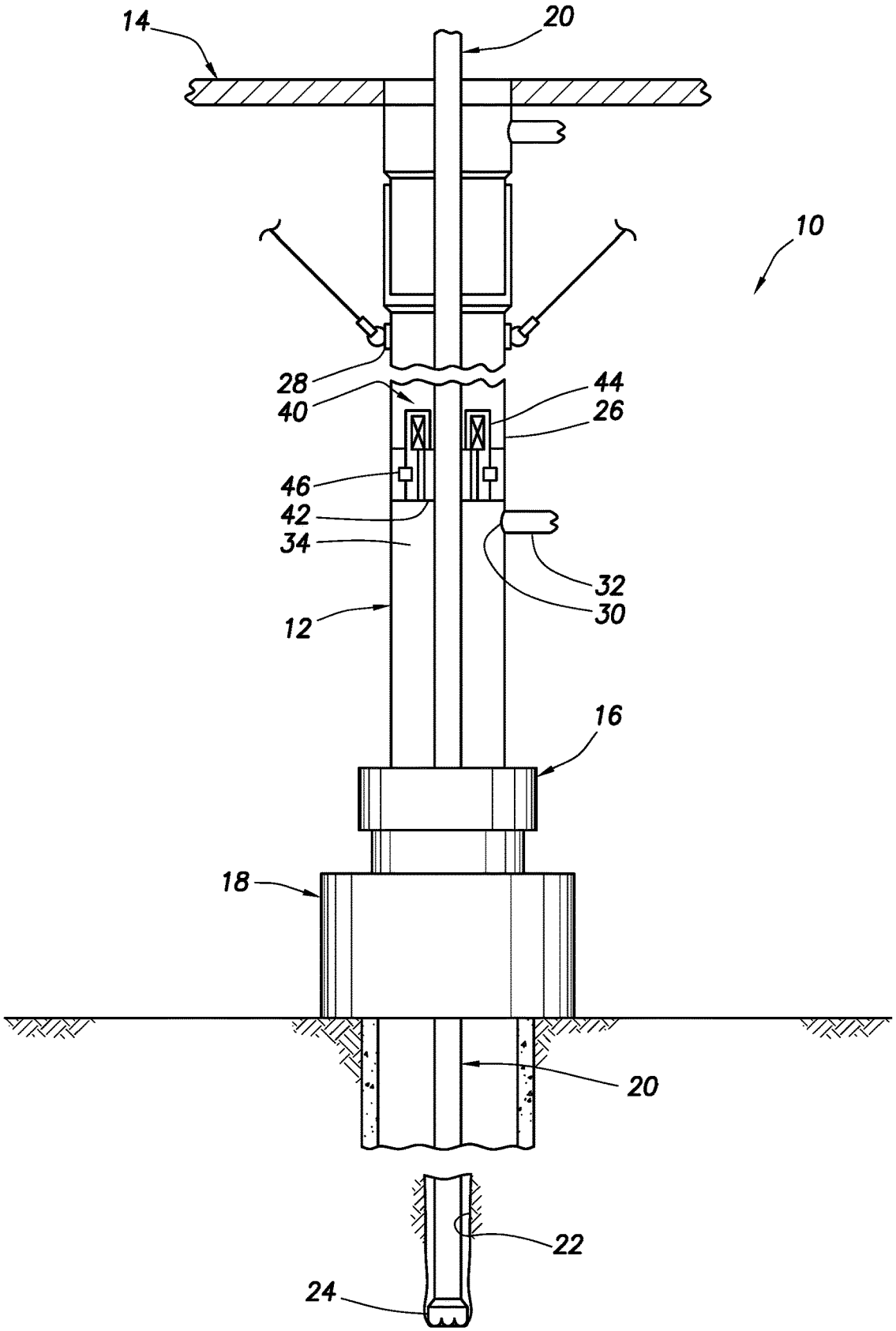
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower end of the tubular string 20.

The drill bit 24 may be rotated by rotating the tubular string 20 (for example, using a top drive or rotary table of the rig 14), and/or a drilling motor may be connected in the tubular string 20 above the drill bit 24. However, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes a riser housing 26 connected in the riser string 12 below a tensioner ring 28 suspended from the rig 14. In other examples, the riser housing 26 could be connected above the tensioner ring 28, or could be otherwise positioned (such as, in the wellhead installation 18 in a riser-less configuration). Thus, the scope of this disclosure is not limited to any particular details of the riser string 12 or riser housing 26 as described herein or depicted in the drawings.

The riser housing 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, a releasable assembly 40 is installed in the riser housing 26. The releasable assembly 40 in this example is of the type known to those skilled in the art as a rotating control device.

However, the scope of this disclosure is not limited to installation or retrieval of any particular type of releasable assembly in the riser housing 26. In other examples, the releasable assembly 40 could comprise a protective sleeve (e.g., having no annular seal for engagement with the tubular string 20), or a non-rotating pressure control device (e.g., having one or more non-rotating annular seals for engagement with the tubular string 20).

In the FIG. 1 example, the releasable assembly 40 includes one or more annular seals 42 that seal off the annulus 34 above the side port 30. In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the riser housing 26 is provided for by a bearing assembly 44 of the releasable assembly 40. The annular seals 42 and bearing assembly 44 are releasably secured in the riser housing 26 by a latch 46. The latch 46 permits the annular seals 42 and/or the bearing assembly 44 to be installed in, or retrieved from, the riser housing 26 when desired, for example, to service or replace the seals 42 and/or bearing assembly 44.

Various components of the latch 46 may be part of, or integral to, the riser housing 26, the releasable assembly 40, or a combination thereof. The scope of this disclosure is not limited to any particular location(s) or configuration of any components or combination of components of the latch 46.

The tubular string 20 can include running and retrieval tools, examples of which are described more fully below and depicted in FIGS. 9 and 12A-29B, for installing and retrieving the releasable assembly 40. However, it should be clearly understood that the scope of this disclosure is not limited to these particular examples of running and retrieval tools, and is not limited to use of a running or retrieval tool as part of the tubular string 20 of FIG. 1.

Figure 2:
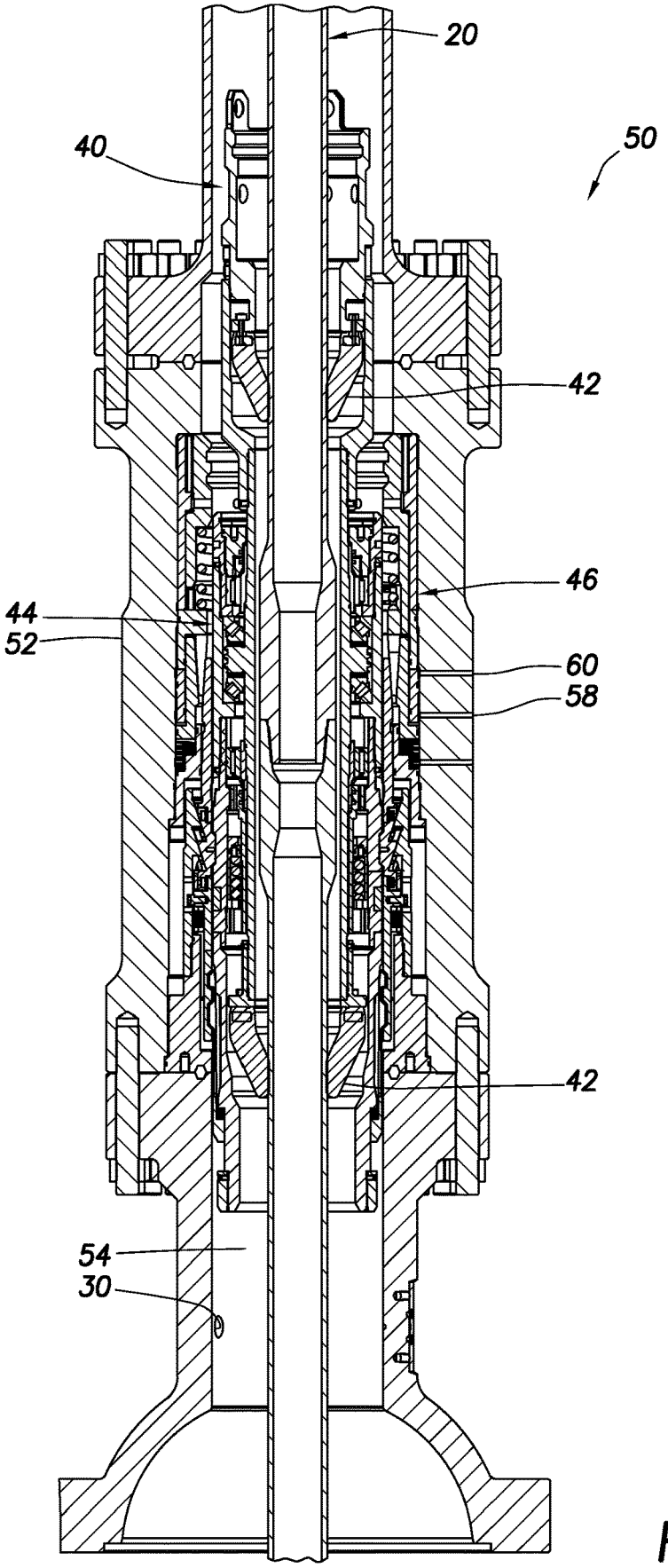
FIG. 2 is a representative cross-sectional view of an example of a pressure control device that may be used in the system and method of FIG. 1.

Referring additionally now to FIG. 2, an example of a pressure control device 50 that may be used in the system 10 and method of FIG. 1 is representatively illustrated. In other examples, the pressure control device 50 could be used with other systems and methods.

FIG. 2 depicts a representative cross-sectional view of an example of the releasable assembly 40 as releasably installed in an outer housing 52 of the pressure control device 50. When used in the system 10 of FIG. 1, the outer housing 52 could comprise the riser housing 26. In other examples, the outer housing 52 may not be connected in a riser string, or may be in another arrangement with respect to other well equipment.

As depicted in FIG. 2, the tubular string 20 is received in the pressure control device 50, so that the tubular string 20 is sealingly engaged by the annular seals 42 of the releasable assembly 40 as the tubular string 20 displaces longitudinally through the pressure control device 50, and optionally as the tubular string 20 rotates within the pressure control device 50. In this configuration, well operations (such as drilling of the wellbore 22) can be performed while an annular space about the tubular string 20 is sealed off with the annular seals 42.

In the FIG. 2 example, the outer housing 52 comprises multiple sections, a lower one of which has the side port 30 formed therein, and an upper one of which encloses the latch 46 for releasably securing the releasable assembly 40. In other examples, the outer housing 52 could comprise other sections or other numbers of sections (including one), and the outer housing 52 could be positioned within one or more other housings. Thus, the scope of this disclosure is not limited to any particular details of the outer housing 52 as described herein or depicted in the drawings.

The releasable assembly 40 as depicted in FIG. 2 includes two of the annular seals 42 for sealing engagement with an exterior of the tubular string 20 when it is positioned in a passage 54 formed longitudinally through the pressure control device 50. The annular seals 42 are rotatably supported relative to the outer housing 52 by the bearing assembly 44.

A running tool 56 (see FIGS. 9 & 12A-29B) can be connected in the tubular string 20 for conveying the releasable assembly 40 through the riser string 12, and into and out of the outer housing 52. The running tool 56 is used in these examples both for installing the releasable assembly 40 in the outer housing 52, and for retrieving the releasable assembly 40 from the outer housing 52 and riser string 12.

As described more fully below, the releasable assembly 40 can be releasably secured in the outer housing 52 by conveying the releasable assembly 40 on the running tool 56 connected in the tubular string 20, engaging the latch 46 to limit further downward displacement of the releasable assembly 40 relative to the outer housing 52, and applying a downwardly directed force to the releasable assembly 40 via the running tool 56 (e.g., by slacking off weight of the tubular string 20 at the rig 14).

When a predetermined downwardly directed force is achieved, the latch 46 is "set," so that the releasable assembly 40 is releasably secured against longitudinal and rotational displacement relative to the outer housing 52. The running tool 56 is then released from the releasable assembly 40, so that the running tool 56 and the remainder of the tubular string 20 can be retrieved from the riser string 12.

To release the running tool 56 from the releasable assembly 40, fluid is circulated through the running tool 56 at or above a predetermined flow rate, and then the flow rate is reduced. As described more fully below, this increase and then decrease in the flow rate actuates an index mechanism that releasably secures the running tool 56 to the releasable assembly 40.

When it is desired to retrieve the releasable assembly 40 from the riser string 12 (for example to perform maintenance on or replace the annular seals 42, bearing assembly 44, or the entire releasable assembly 40), the running tool 56 can again be connected in the tubular string 20 and conveyed into the releasable assembly 40. The releasable assembly 40 is then retrieved by applying a predetermined downwardly directed force to the releasable assembly 40 via the running tool 56 (e.g., by slacking off weight of the tubular string 20 at the rig 14), circulating fluid through the running tool 56 at or above a predetermined flow rate, reducing the flow rate, and then applying pressure to the latch 46 (e.g., hydraulic pressure applied via ports 58, 60 formed through the outer housing 52). The predetermined circulation flow rate and predetermined downwardly directed force applied in this retrieval operation may be the same as, or different from, the respective predetermined circulation flow rate and predetermined downwardly directed force applied in the above-described installation operation.

The increase and then decrease in the circulation flow rate actuates the index mechanism that releasably secures the running tool 56 to the releasable assembly 40. When a sufficient pressure is applied to the latch 46, the latch 46 disengages and the releasable assembly 40 can be displaced upward relative to the outer housing 52, with the running tool 56 secured to the releasable assembly 40.

Although the running tool 56 is described herein as being used to both install and retrieve the releasable assembly 40, in other examples different running tools may be used for respectively installing and retrieving the releasable assembly 40, the releasable assembly 40 may not be both installed and retrieved (e.g., the releasable assembly 40 could be only installed or only retrieved), or the releasable assembly 40 may not be retrieved after it is installed. Thus, the scope of this disclosure is not limited to any particular steps performed in any particular order or combination, or to any particular purpose or configuration of the running tool 56.

Figure 3:
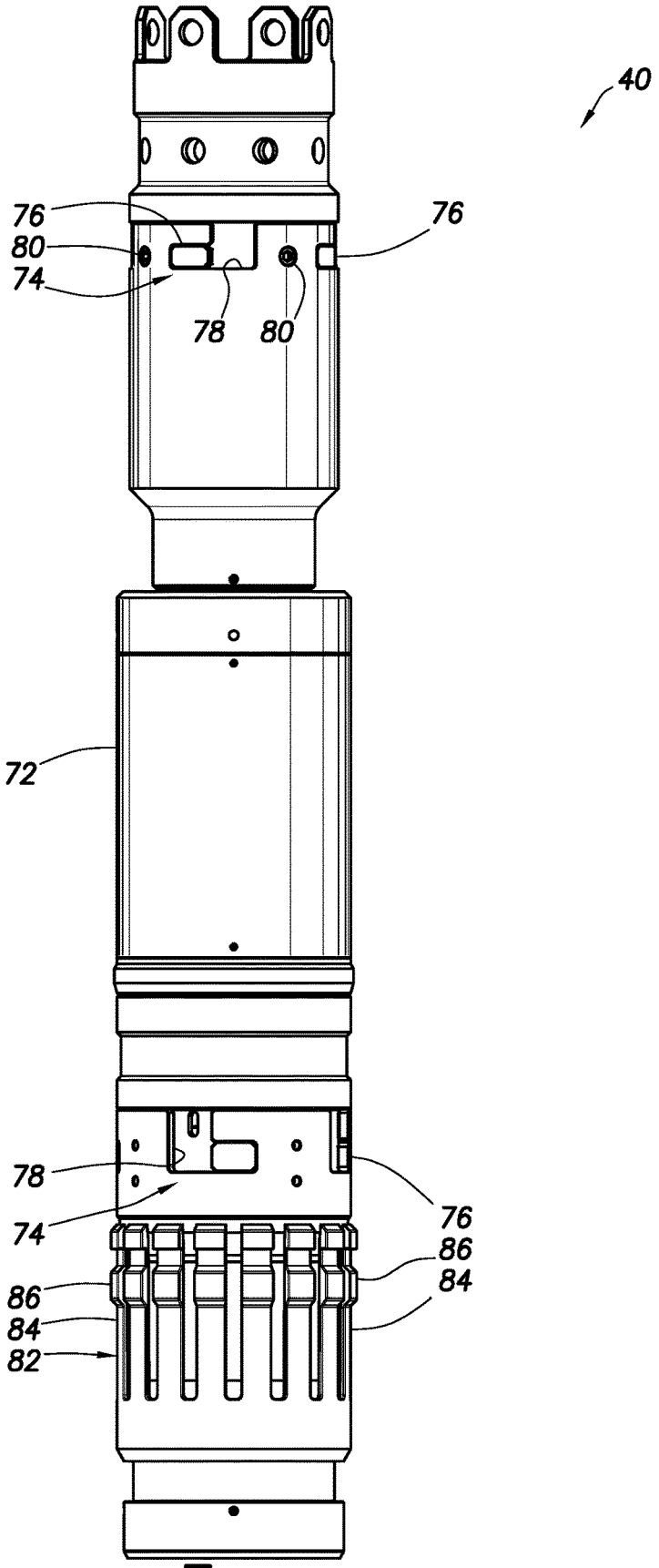
FIGS. 3 & 4 are representative elevational and cross-sectional views of an example of a releasable assembly of the pressure control device.
Figure 4:
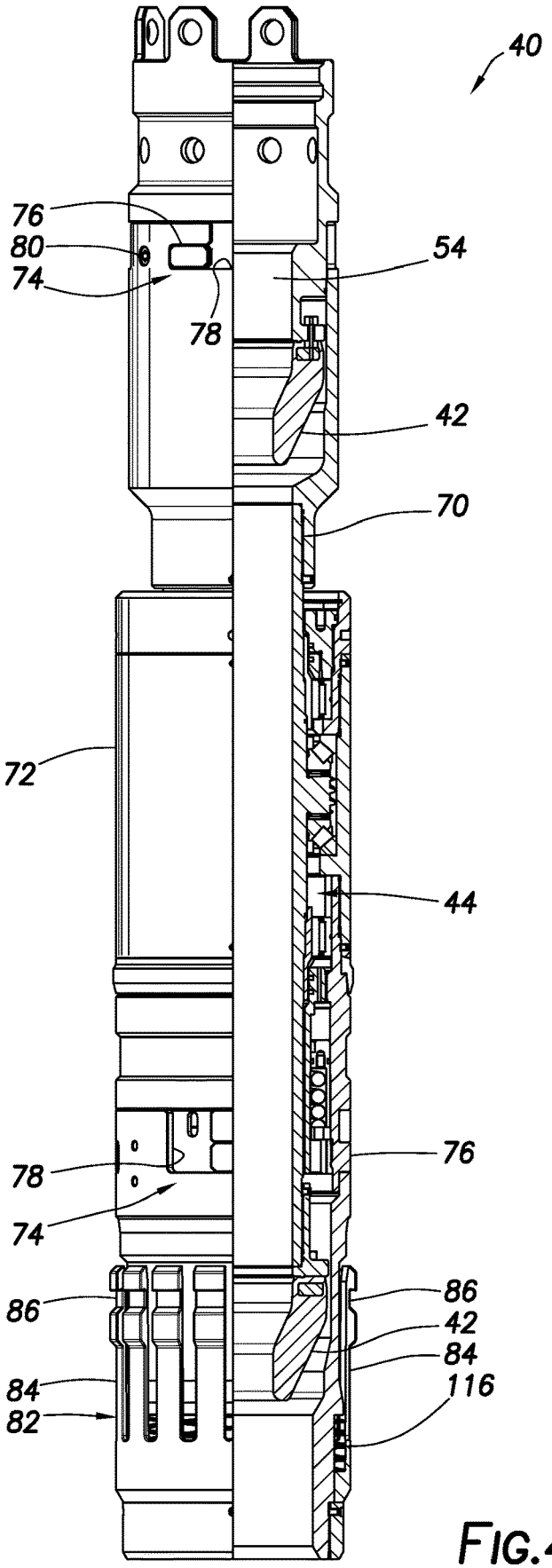

Referring additionally now to FIGS. 3 & 4, representative elevational and cross-sectional views of the releasable assembly 40 are representatively illustrated. In these views, it may be seen that the annular seals 42 are connected to a generally tubular inner mandrel 70, which is rotatably supported in an outer housing 72 by the bearing assembly 44.

The outer housing 72 may include any number of sections (including one) and may be otherwise configured. Thus, the scope of this disclosure is not limited to any particular details of the outer housing 72 or any other components of the releasable assembly 40 as described herein or depicted in the drawings.

The annular seals 42 are conveniently accessible for installation or replacement by means of circumferentially distributed "J" locks 74. Each of the J locks 74 includes lugs 76 and "J" or "L"-shaped slots 78 for providing access to the annular seals 42 in the releasable assembly 40. Fasteners 80 (such as, screws or bolts) can be used to retain the J locks 74 in locked configurations.

In FIGS. 3 & 4, it may also be seen that the releasable assembly 40 includes a collet mechanism 82 comprising multiple circumferentially distributed flexible collets 84. Each of the collets 84 has an external profile 86 formed thereon for cooperative engagement in the latch 46 (see FIG. 2). In other examples, dogs, lugs or other types of engagement members may be substituted for various collets 84, 188 described herein.

As described more fully below, the collet mechanism 82 is configured to locate the releasable assembly 40 relative to the outer housing 52, and to initiate setting of the latch 46. The collets 84 are biased downward relative to the outer housing 72 by a spring 116, which permits the outer housing 72 and most of the remainder of the releasable assembly 40 to displace downward somewhat relative to the collets 84 after the collets have engaged the latch 46. Such downward displacement relative to the collets 84 occurs during the installation operation, when the predetermined downwardly directed force is applied to the releasable assembly 40 to initiate setting of the latch 46.

Figure 5:
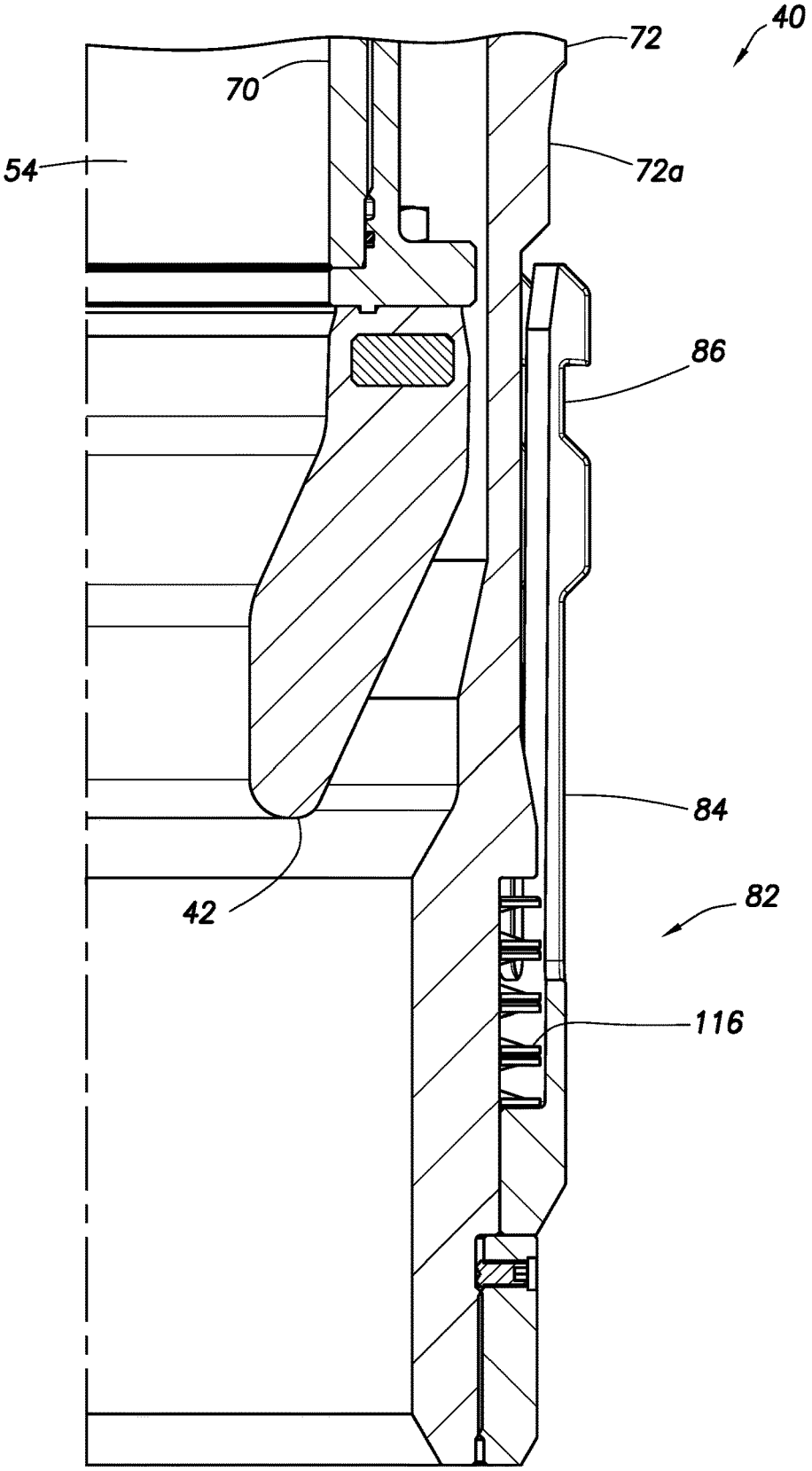
FIG. 5 is a representative enlarged scale cross-sectional view of a portion of the releasable assembly.

Referring additionally now to FIG. 5, an enlarged scale cross-sectional view of a portion of the releasable assembly 40 is representatively illustrated. In this view, further details of the collet mechanism 82 may be seen.

As depicted in FIG. 5, the collet mechanism 82 is in a run-in configuration, in which the collets 84 can flex radially inward, for example, to allow the collet mechanism 82 and the remainder of the releasable assembly 40 to pass through obstructions and restrictions in the riser string 12 (see FIG. 1). However, the external profiles 86 are specially configured to engage a complementarily-shaped internal profile 110 in the latch 46 (see FIG. 7) as the releasable assembly 40 is displaced downwardly into the latch during installation.

When the collet profiles 86 are engaged with the profile 110 of the latch 46, further downward displacement of the remainder of the releasable assembly 40 will cause the spring 116 to compress, and the outer housing 72 of the releasable assembly 40 will displace downward relative to the collets 84. Such downward displacement of the outer housing 72 relative to the collets 84 will cause the profiles 86 to be radially outwardly supported in engagement with the internal latch profile 110 by a support diameter 72*a* formed on the outer housing 72.

Figure 6:
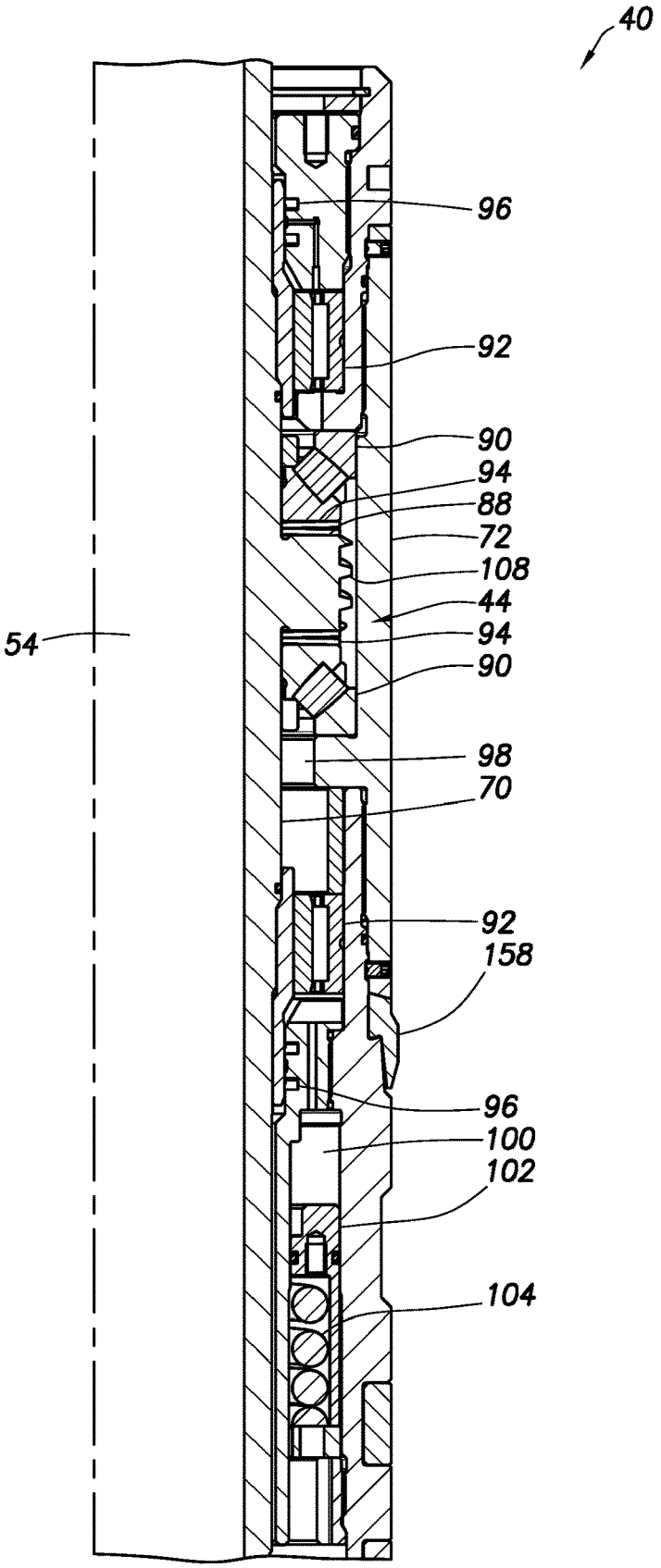
FIG. 6 is a representative cross-sectional view of another portion of the releasable assembly.

Referring additionally now to FIG. 6, a cross-sectional view of another portion of the releasable assembly 40 is representatively illustrated. In this view, further details of the bearing assembly 44 may be seen.

A radially enlarged annular structure 88 formed on the inner mandrel 70 is axially or longitudinally supported between two thrust bearings 90 of the bearing assembly 44. The inner mandrel 70 is also radially supported by radial bearings 92. Thus, the inner mandrel 70 (and the connected annular seals 42) can rotate freely within the outer housing 72, but the inner mandrel 70 is prevented from displacing substantially axially relative to the outer housing 72 (although very limited axial displacement may be possible, e.g., with springs (such as Bellville springs) 94 positioned between the annular structure 88 and each of the bearings 90 to compensate for manufacturing tolerances and nominal clearances).

Rotary seals 96 seal off opposite ends of a lubricant-filled lubricant flow path 98 exposed to the bearings 90, 92. In this example, the rotary seals 96 may be of the type known to those skilled in the art as "controlled leakage" rotary seals that provide for a limited amount of leakage, so that the sealing contact between the seals 96 and the seal surfaces they engage is continuously flushed of debris and lubricated, although other types of rotary seals may be used in other examples.

The lubricant flow path 98 is in communication with a pressurized lubricant chamber 100, so that the lubricant flow path 98 is continuously supplied with lubricant from the lubricant chamber 100. The lubricant chamber 100 is pressurized by means of an annular piston 102 that is biased toward the chamber 100 by a biasing force exerted by a spring 104.

Opposite the chamber 100, the piston 102 is exposed to pressure in the passage 54 below the lower annular seal 42. In this manner, during drilling or other operations, when the annular seal 42 is sealingly engaged with the tubular string 20 (see FIG. 1), the lubricant chamber 100 will be pressurized to a level equal to the pressure in the passage 54 below the lower annular seal 42 (which in the FIG. 1 system 10 is also the pressure in the annulus 34) exposed to the piston 102, plus a pressure due to the biasing force exerted on the piston 102 by the spring 104. Thus, there is always a positive pressure differential from the lubricant flow path 98 and chamber 100 to the passage 54.

As the inner mandrel 70 rotates (due, for example, to rotation of the tubular string 20 in the passage 54 while engaged by the annular seals 42), a flow inductive profile 108 formed on the annular structure 88 induces the lubricant to flow through the flow path 98. In this manner, the lubricant is continuously circulated about the bearings 90, 92 as the inner mandrel 70 rotates.

The flow inductive profile 108 could in some examples be provided as a relatively coarse helical thread on the annular structure 88. In other examples, the profile 108 could comprise multiple vanes or a flow inducing rotor. Any type of flow inductive profile may be used in keeping with the scope of this disclosure.

Figure 15:
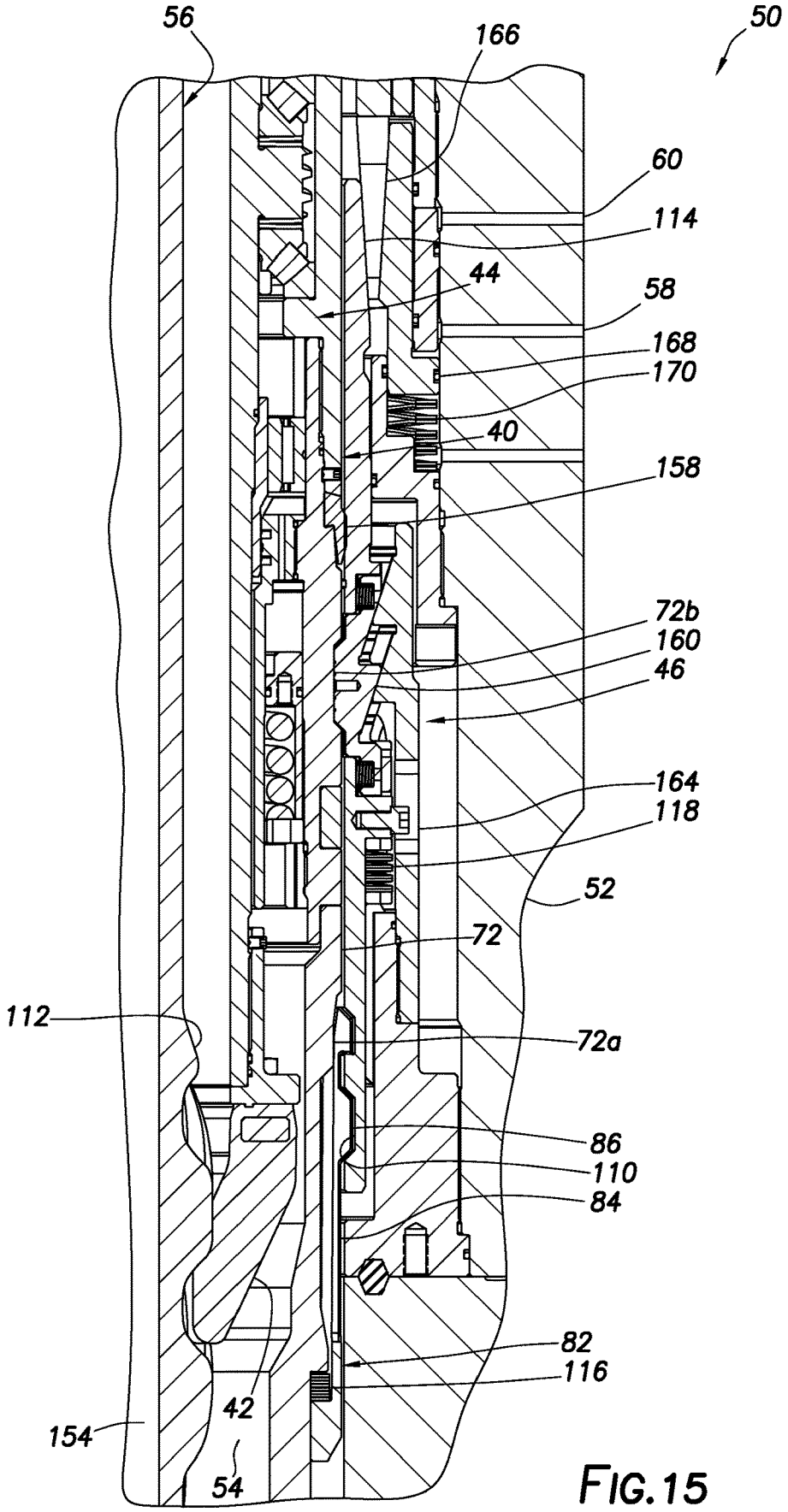
FIG. 15 is a representative cross-sectional view of a portion of the pressure control device.

An annular seal 158 carried on the outer housing 72 seals off an annular gap between the releasable assembly 40 and the latch 46 when the releasable assembly is received in the latch (see FIG. 15).

Figure 7:
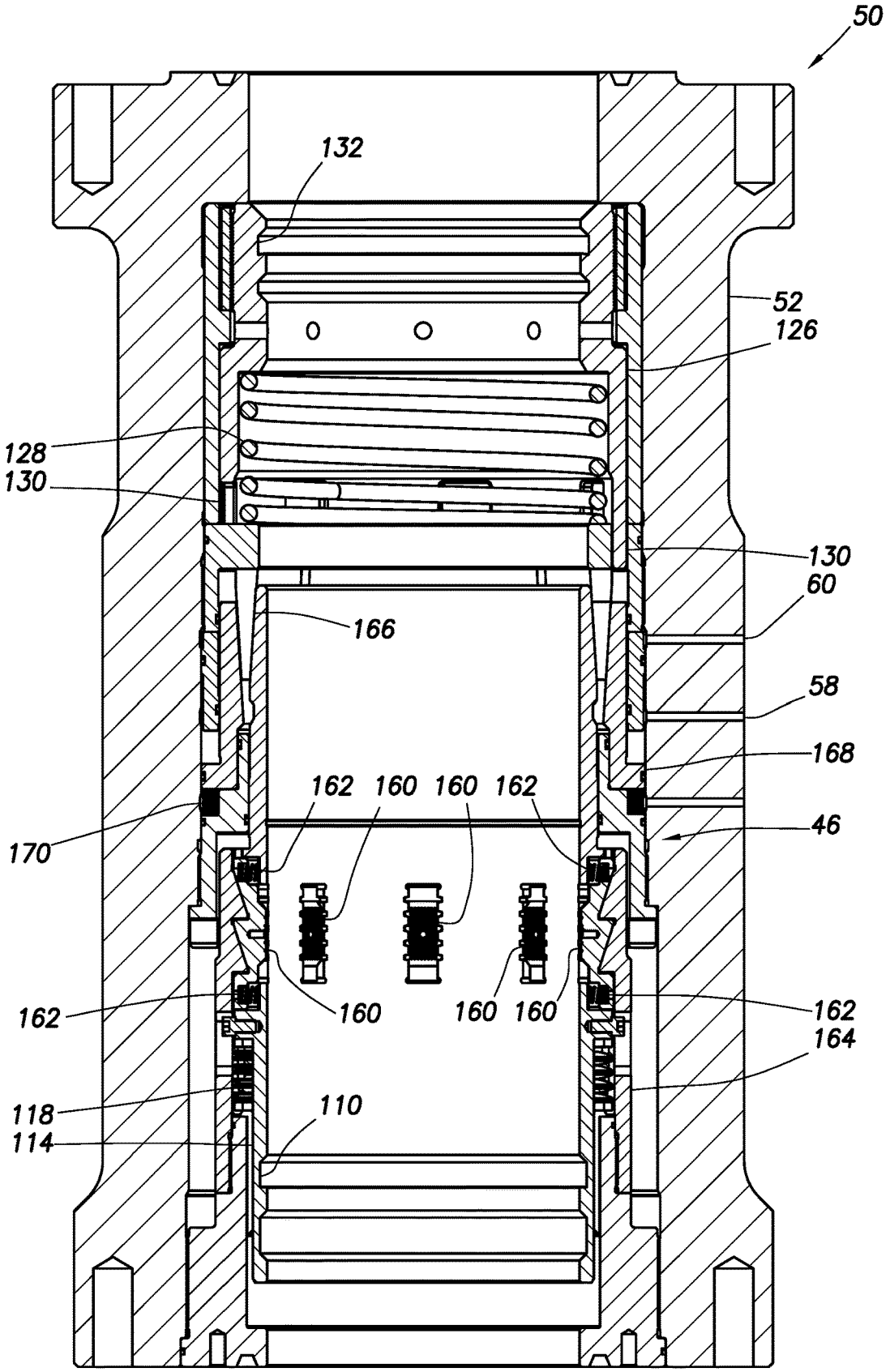
FIG. 7 is a representative cross-sectional view of a portion of the pressure control device outer housing and latch.

Referring additionally now to FIG. 7, a cross-sectional view of a portion of the pressure control device outer housing 52 and latch 46 is representatively illustrated. In this view, the latch 46 is in an unset configuration, and the releasable assembly 40 is not received in the latch (e.g., the releasable assembly is not yet installed in the latch, or has been retrieved from the latch).

Note that the internal profile 110 is configured such that the collet profiles 86 (see FIG. 5) will engage the profile 110 as the collet mechanism 82 displaces downward through the latch 46. After the profiles 86, 110 are engaged in this manner, further downward displacement of the collet mechanism 82 and the remainder of the releasable assembly 40 will cause a setting sleeve 114 (in which the profile 110 is formed) to displace downward also, in order to set the latch 46.

The collets 84 are biased downward by the spring 116 (see FIG. 5), and the setting sleeve 114 is biased upward by a spring 118. After the profiles 86, 110 are engaged with each other and the downwardly directed force is applied to the releasable assembly 40, the spring 116 is compressed (due to downward displacement of the releasable assembly 40 relative to the collets 84), and the spring 118 is compressed (due to downward displacement of the setting sleeve 114 with the collets 84).

The downward displacement of the releasable assembly 40 relative to the collets 84 causes upper ends of the collets 84 to be positioned radially between the internal profile 110 and the radially enlarged portion 72*a* of the outer housing 72, so that the external profiles 86 are prevented from disengaging from the internal profile 110.

The latch 46 includes circumferentially distributed and radially displaceable grip members or slips 160 received in the setting sleeve 114. The slips 160 displace longitudinally with the setting sleeve 114.

The slips 160 are biased radially outward by springs 162. However, when the setting sleeve 114 and slips 160 displace downward as described more fully below, the slips 160 are also displaced radially inward due to cooperation between inclined surfaces formed on the slips 160 and in a slip housing 164 of the latch 46.

An upper end of the setting sleeve 114 is externally tapered. When the setting sleeve 114 displaces downward, a radially extendable and retractable frusto-conical setting ring 166 is permitted to radially retract. The setting ring 166 has internal and external tapered surfaces.

A piston 168 sealingly and reciprocably positioned in the outer housing 52 has a tapered internal surface that engages the tapered external surface of the setting ring 166. The piston 168 is biased upward by one or more springs 170.

As the setting sleeve 114 displaces downward, the setting ring 166 radially retracts and the piston 168 displaces upward somewhat, due to the biasing force exerted by the springs 170 and the inclined surfaces engaged between the setting ring 166 and the piston 168. Because the setting ring 166 has been radially retracted and the piston 168 now radially outwardly supports the setting ring 166 in its radially retracted configuration, the setting sleeve 114 cannot now displace upward to unset the latch 46. Thus, the setting ring 166, the springs 170, and the tapered surfaces on and in the setting sleeve 114 and piston 168 function as a locking mechanism to prevent unsetting of the latch 46 after it has been set.

A release sleeve 126 is biased upward relative to the outer housing 52 by a spring 128. The release sleeve 126 includes downwardly extending circumferentially distributed projections 130 aligned with the piston 168.

The release sleeve 126 also includes an internal profile 132 that can be operatively engaged by external profiles 134 on a contingency retrieval tool 136 (see FIG. 23), in order to downwardly displace the release sleeve 126, to thereby downwardly displace the piston 168, in the event that pressure applied to the release port 58 and the backup release port 60 does not result in sufficient downward displacement of the piston 168 when it is desired to unset the latch 46. This contingency unsetting operation is described more fully below in relation to FIGS. 23-29B.

Figure 8:
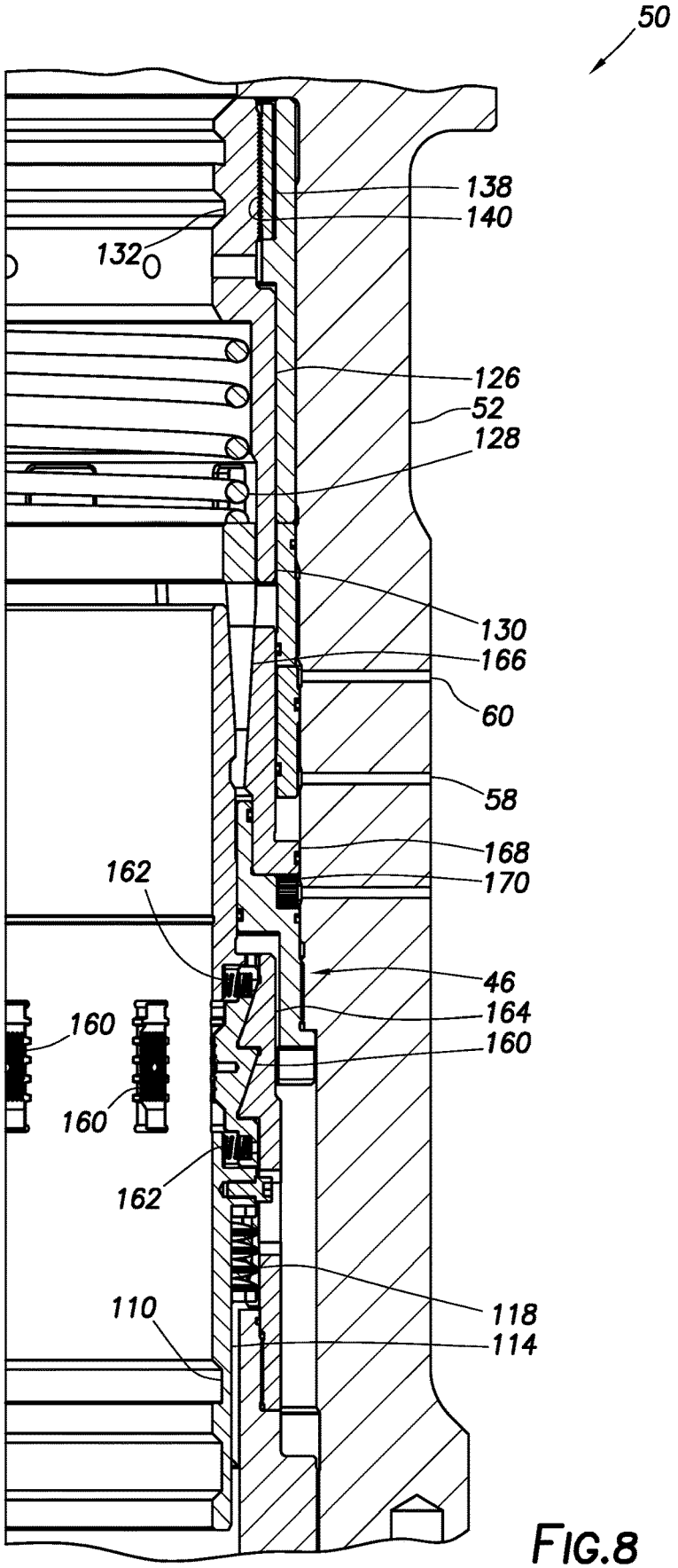
FIG. 8 is a representative further enlarged scale cross-sectional view of the latch of the pressure control device.

Referring additionally now to FIG. 8, a further enlarged scale view of the latch 46 of the pressure control device 50 is representatively illustrated. In this view, further details of the latch 46 can be more clearly seen.

Note that a lock ring 138 having an internal gripping surface 140 is disposed resiliently about an upper end of the release sleeve 126. For example, the lock ring 138 could be generally C-shaped and biased radially inward toward the release sleeve 126.

The gripping surface 140 grips an outer surface of the release sleeve 126, so that downward displacement of the release sleeve 126 is permitted, but the gripping surface 140 is configured to inhibit upward displacement of the release sleeve. For example, the gripping surface 140 may comprise small buttress-type threads or profiles that grip the outer surface of the release sleeve 126 in only one direction. The outer surface of the release sleeve 126 may also have suitable threads or other profiles formed thereon.

Figure 9:
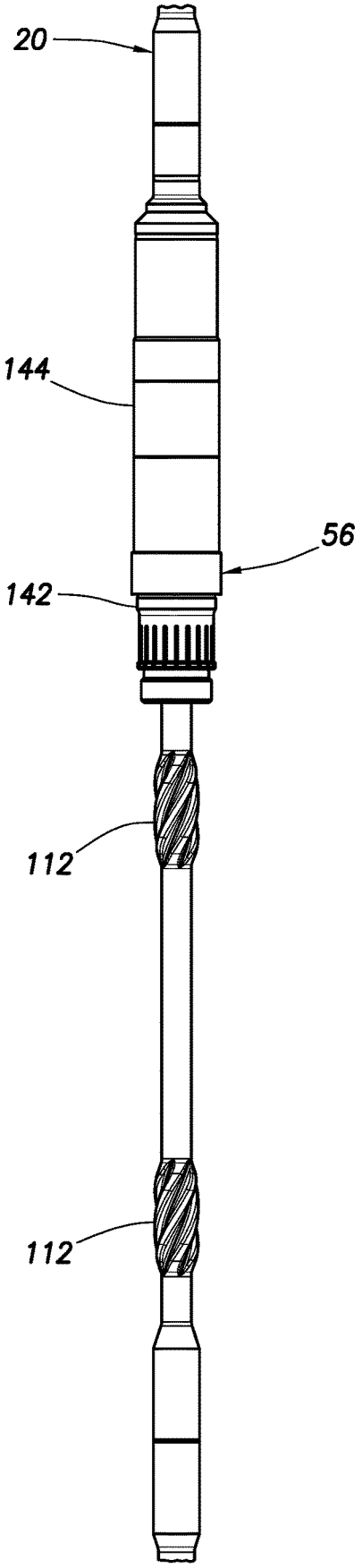
FIG. 9 is a representative elevational view of an example of a running tool that may be used for conveying the releasable assembly.

Referring additionally now to FIG. 9, an elevational view of the running tool 56 is representatively illustrated. As depicted in FIG. 9, the running tool 56 is connected as part of the tubular string 20, as used in the system 10 and method of FIG. 1. However, the running tool 56 may be used in other systems and methods, and may be conveyed by means other than the tubular string 20, in keeping with the principles of this disclosure.

In the FIG. 9 example, the running tool 56 includes a lock mechanism 142 and an index mechanism 144. The lock mechanism 142 is used to releasably secure the running tool 56 to the releasable assembly 40. The index mechanism 144 operates the lock mechanism 142 in response to changes in a fluid flow rate through the running tool 56, as described more fully below.

In addition, the running tool 56 includes helical flutes 112 formed on a generally tubular portion extending downwardly from the lock mechanism 142. The helical flutes 112 will be positioned within the annular seals 42 of the releasable assembly 40 when the releasable assembly is installed in the pressure control device 50, as described more fully below.

Figure 10:
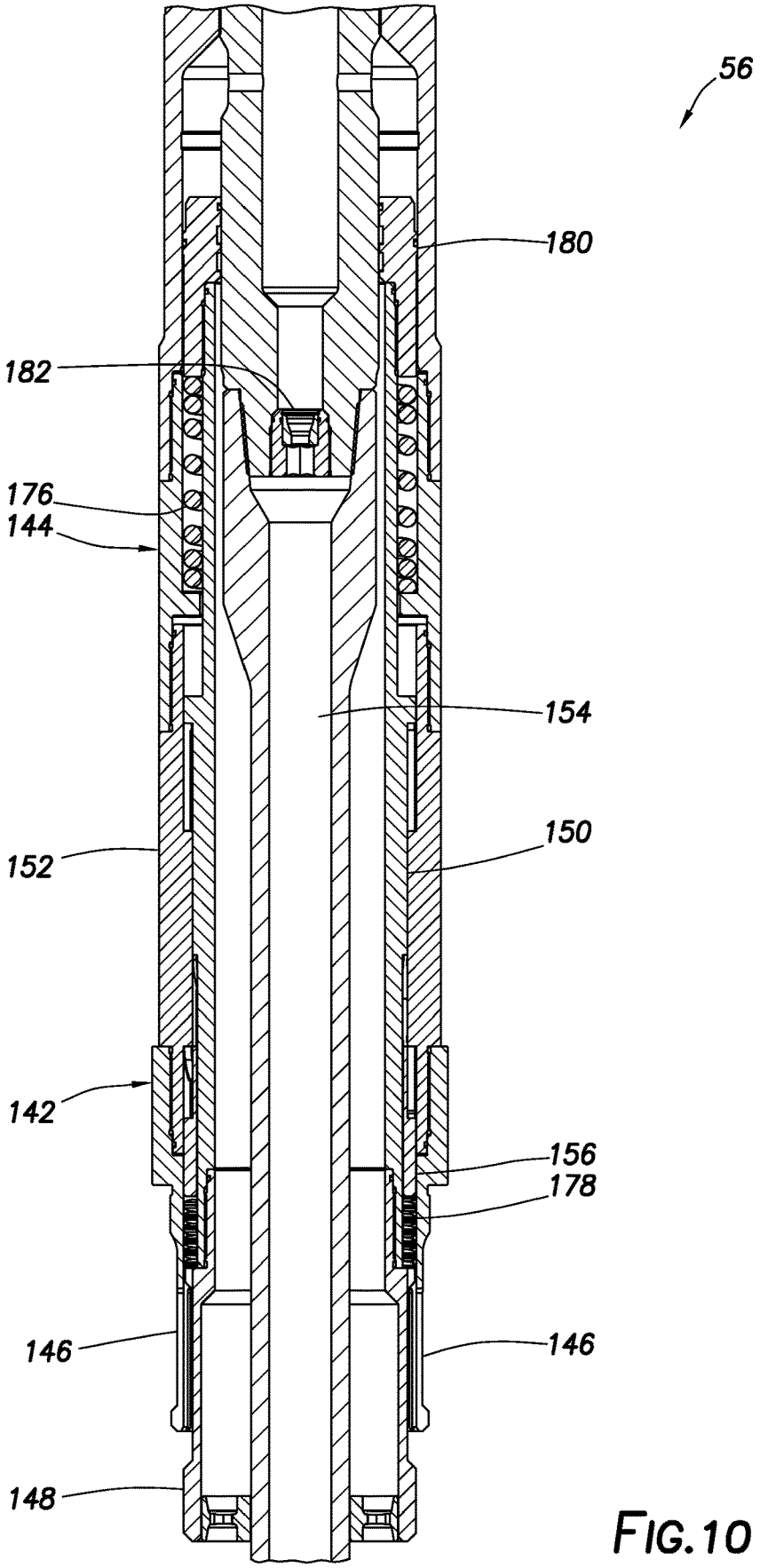
FIG. 10 is a representative cross-sectional view of a portion of the running tool.

Referring additionally now to FIG. 10, a cross-sectional view of a portion of the running tool 56 is representatively illustrated. In this view, further details of the running tool 56 may be seen.

In the FIG. 10 example, the lock mechanism 142 is in a released configuration, with collets or other resiliently biased engagement members 146 being unsupported. The engagement members 146 can flex radially inward as depicted in FIG. 10, but can be prevented from flexing radially inward by displacement of an annular support structure 148 to a position radially underlying the engagement members 146.

The support structure 148 is formed as a radially enlarged portion connected to an indexing sleeve 150 of the index mechanism 144. The indexing sleeve 150 cooperates with an outer indexing housing 152 and internal indexing collar 156 of the index mechanism 144 to displace the support structure 148 alternately to released and secured positions relative to the engagement members 148, in response to changes in the fluid flow rate through an internal flow passage 154 formed longitudinally through the running tool 56.

The indexing sleeve 150 is biased upwardly relative to the indexing housing 152 by a spring 176. The indexing collar 156 is biased upwardly relative to the indexing sleeve 150 by another spring 178.

A piston 180 is connected at an upper end of the indexing sleeve 150. An upper side of the piston 180 is exposed to pressure in the flow passage 154 above an orifice 182. As will be appreciated by those skilled in the art, as a flow rate through the orifice 182 increases, a pressure differential across the orifice also increases, resulting in increased pressure being applied to the upper side of the piston 180.

Thus, when the flow rate is at a sufficient level, the piston 180 will displace downwardly against a biasing force exerted by the spring 176. When the flow rate is less than the sufficient level, the spring 176 will displace the piston 180 upward.

Of course, the biasing force exerted by the spring 176 increases as the spring compresses, and so a predetermined fluid flow rate through the passage 154 is required to displace the indexing sleeve 150 fully downward to actuate the index mechanism 144. This predetermined fluid flow rate can be adjusted as desired, for example, by varying a size of the orifice 182, a piston area of the piston 180, and/or a spring rate of the spring 176.

In the FIG. 10 example, the fluid flow rate can be increased to at least the predetermined fluid flow rate to downwardly displace the indexing sleeve 150, and the fluid flow rate can then be decreased to upwardly displace the indexing sleeve 150. This combination of a flow rate increase and then a flow rate decrease can be performed once in some examples, in order to displace the support structure 148 between its released and secured positions, or the combination can be repeated as many times as desired to cycle the support structure 148 repeatedly between its secured and released positions.

Figure 11:
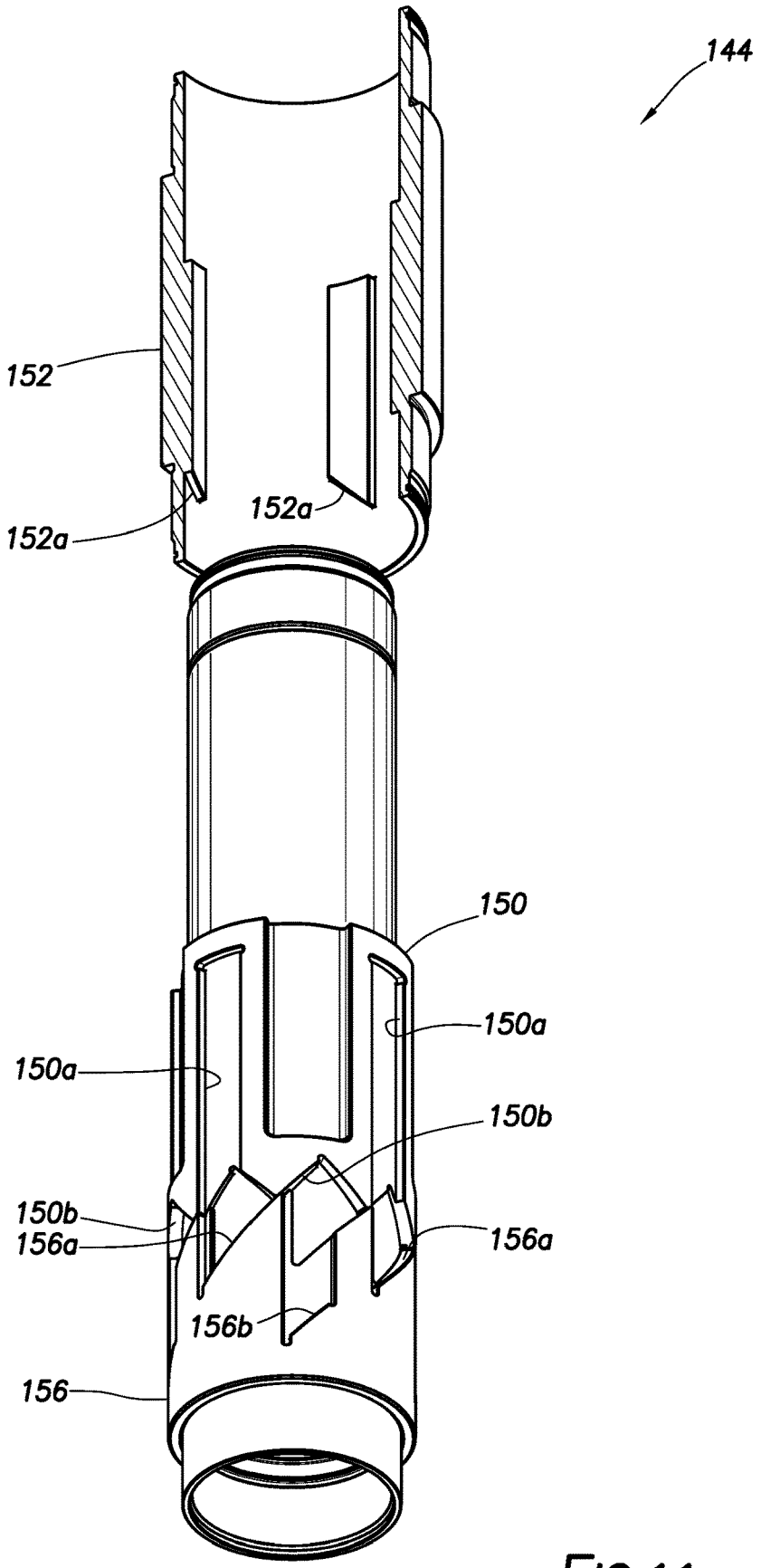
FIG. 11 is a representative perspective view of indexing components of an index mechanism of the running tool.

Referring additionally now to FIG. 11, a perspective view of the indexing components of the index mechanism 144 are representatively illustrated, apart from the remainder of the running tool 56. In this view, the manner in which the indexing sleeve 150 displaces the support structure 148 between its released and secured positions can be more readily seen.

The indexing housing 152 includes internal circumferentially spaced apart and longitudinally extending profiles 152*a* that are slidingly received in circumferentially spaced apart and longitudinally extending slots 150*a* formed on the indexing sleeve 150. The indexing sleeve 150 also has circumferentially spaced apart inclined profiles 150*b* formed thereon that cooperatively engage circumferentially spaced apart inclined profiles 156*a* formed on the indexing collar 156.

Note that the indexing collar 156 also has longitudinally extended profiles 156*b* formed thereon alternated with the profiles 156*a*. Thus, when the profiles 152*a* are received in the profiles 156*b*, the indexing sleeve 150 is displaced farther longitudinally upward relative to the indexing housing 152, as compared to when the profiles 152*a* are received in the profiles 156*a*.

The profiles 150*a,b* (and the profiles 152*a* received in the profiles 150*a*) rotate with the indexing sleeve 150 relative to the indexing collar 156 due to the engagement between the profiles 150*b* and the profiles 156*a*. As a result, on alternate flow rate decreases (when the spring 176 displaces the indexing sleeve 150 upward), the profiles 152*a* are received in the slots 156*b*.

However, on the intermediate flow rate decreases, the profiles 152*a* are not received in the slots 156*b*, but are instead received in the profiles 156*a*. This prevents the indexing sleeve 150 from displacing farther upward on the intermediate flow rate decreases. Thus, the indexing sleeve 150 (and the connected support structure 148) will displace fully upward on every other flow rate decrease, following a flow rate increase to at least the predetermined flow rate, but the indexing sleeve 150 (and the connected support structure 148) will displace only partially upward on intermediate flow rate decreases following flow rate increases to at least the predetermined flow rate.

It will be appreciated by those skilled in the art that the index mechanism 144 is of the type known to those skilled in the art as a "ratchet" mechanism. Other types of ratchet mechanisms that could be used in place of the index mechanism 144 include "J-slot" mechanisms. Thus, the scope of this disclosure is not limited to the details of the index mechanism 144 or to any other particular details of the running tool 56.

Figure 12A:
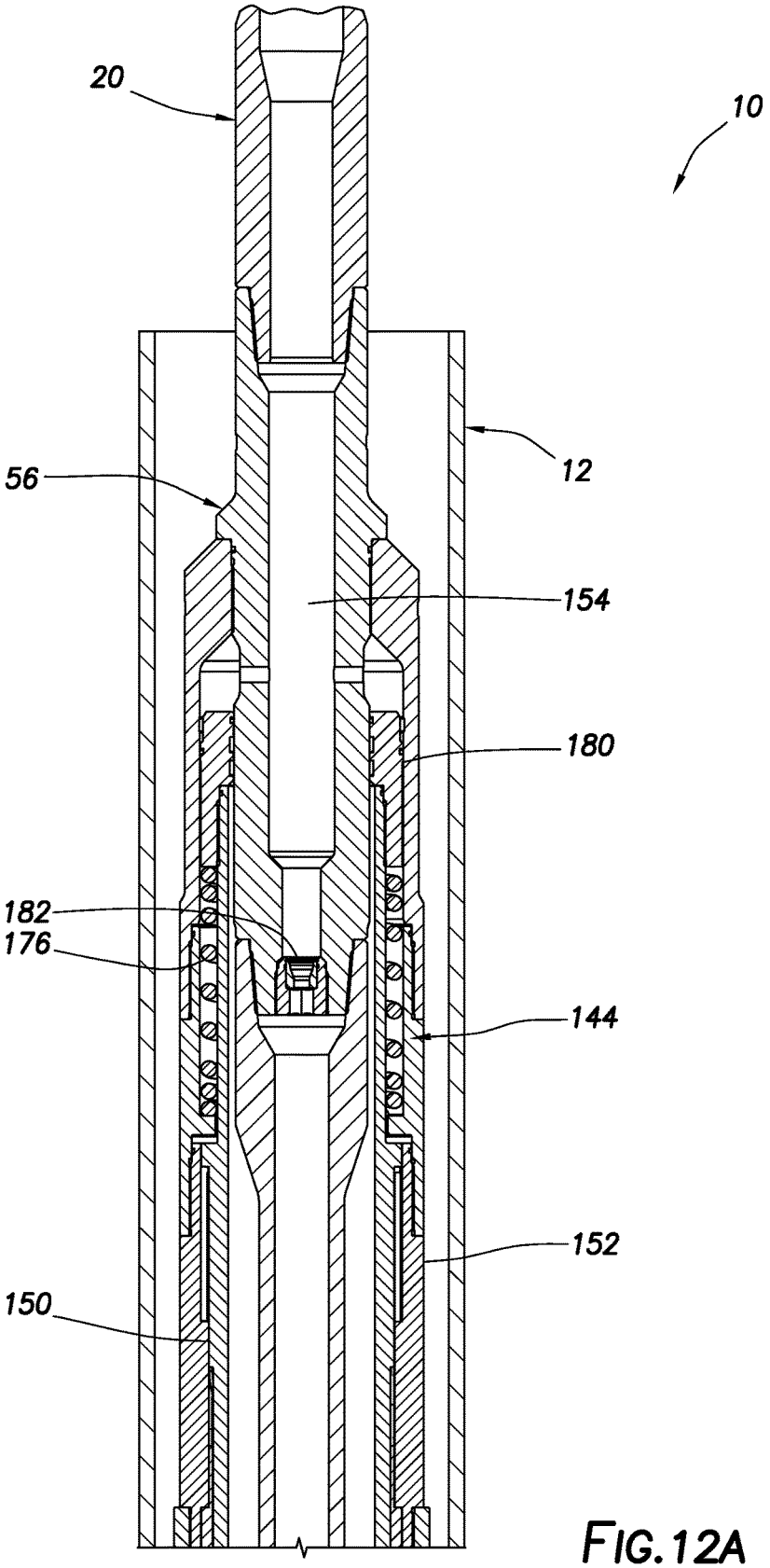
FIGS. 12A-C are representative cross-sectional views of successive longitudinal sections of the releasable assembly being conveyed by the running tool through a riser string and into the latch and outer housing of the pressure control device in the system and method of FIG. 1.
Figure 12B:
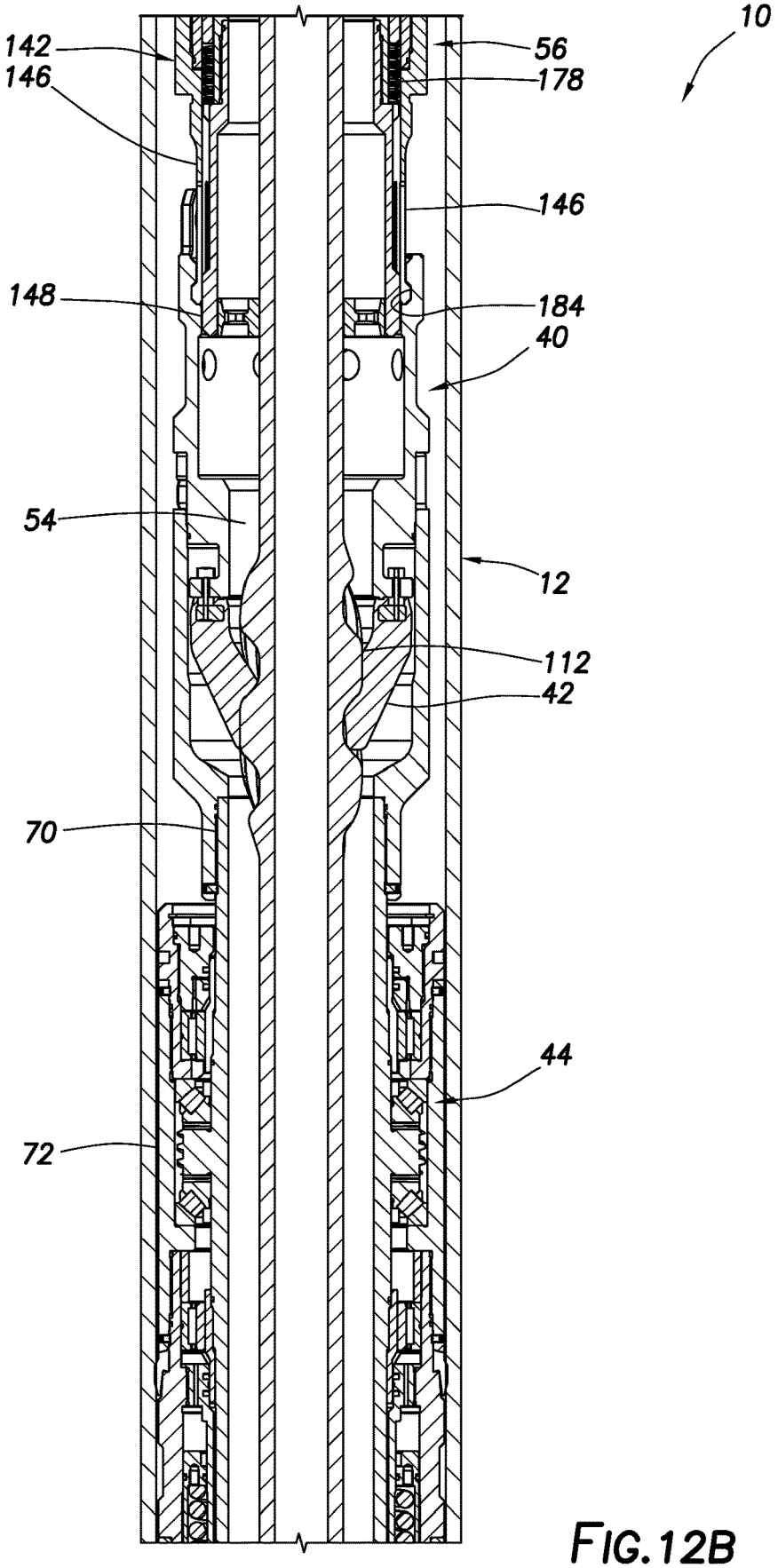
Figure 12C:
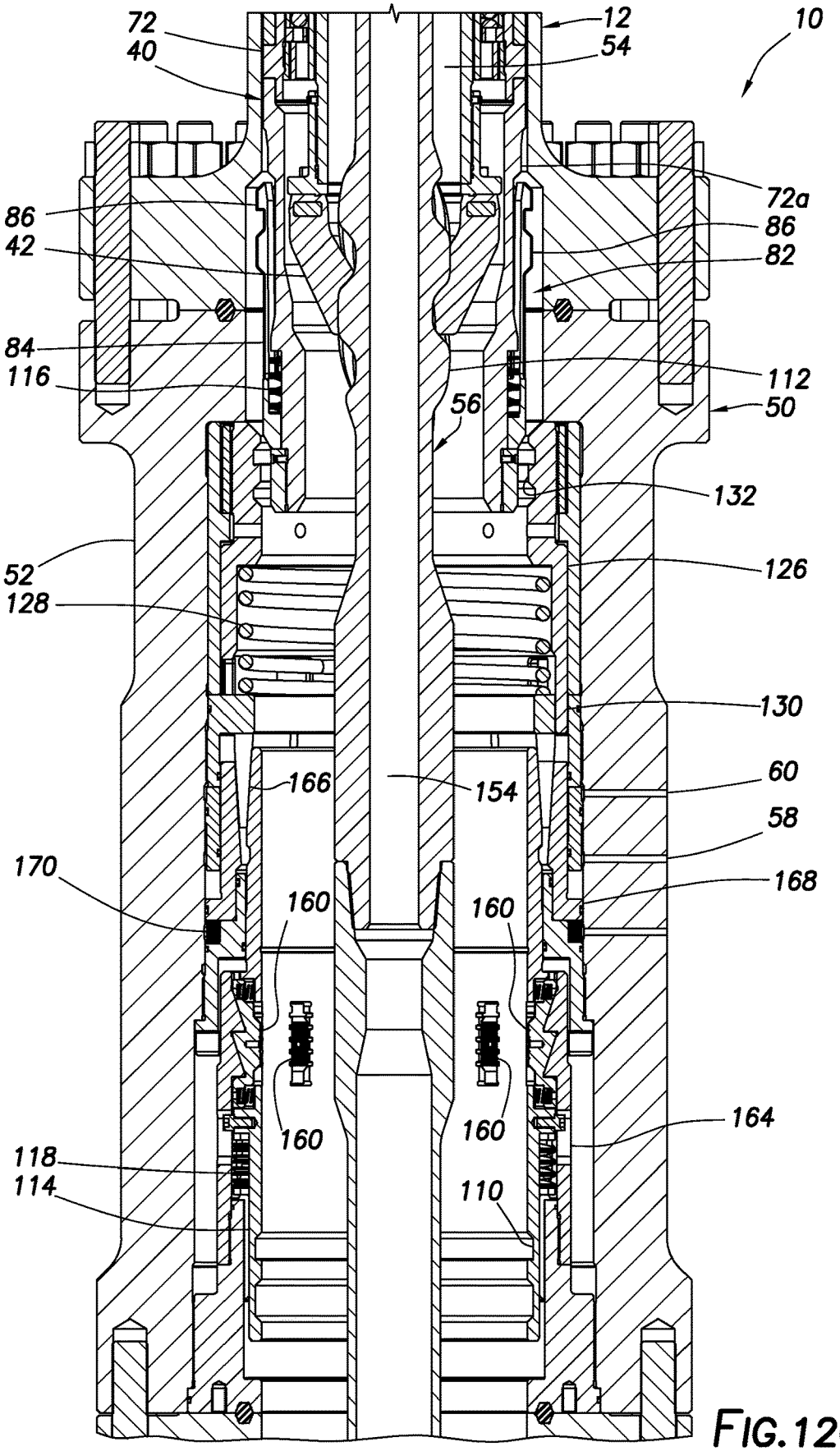

Referring additionally now to FIGS. 12A-C, cross-sectional views of successive longitudinal sections of the releasable assembly 40 being conveyed by the running tool 56 through the riser string 12 and into the latch 46 and outer housing 52 of the pressure control device 50 in the system 10 and method of FIG. 1 are representatively illustrated. However, the releasable assembly 40, pressure control device 50 or running tool 56 may be used with other systems and methods in keeping with the principles of this disclosure.

As depicted in FIG. 12B, the engagement members 146 of the running tool 56 are radially outwardly supported by the support structure 148 in engagement with an internal profile 184 formed in the releasable assembly 40 above the upper annular seal 42. The helical flutes 112 on the running tool 56 are positioned within the respective annular seals 42, so that pressure differentials are not created in the flow passage 54 across the annular seals 42.

As depicted in FIG. 12C, the collets 84 are able to flex radially inward, since they are not radially inwardly supported by the support diameter 72*a* on the outer housing 72 of the releasable assembly 40. However, the external profiles 86 on the collets 84 are resiliently maintained in an appropriate radial position to eventually engage the internal profile 110 of the latch 46.

Figure 13:
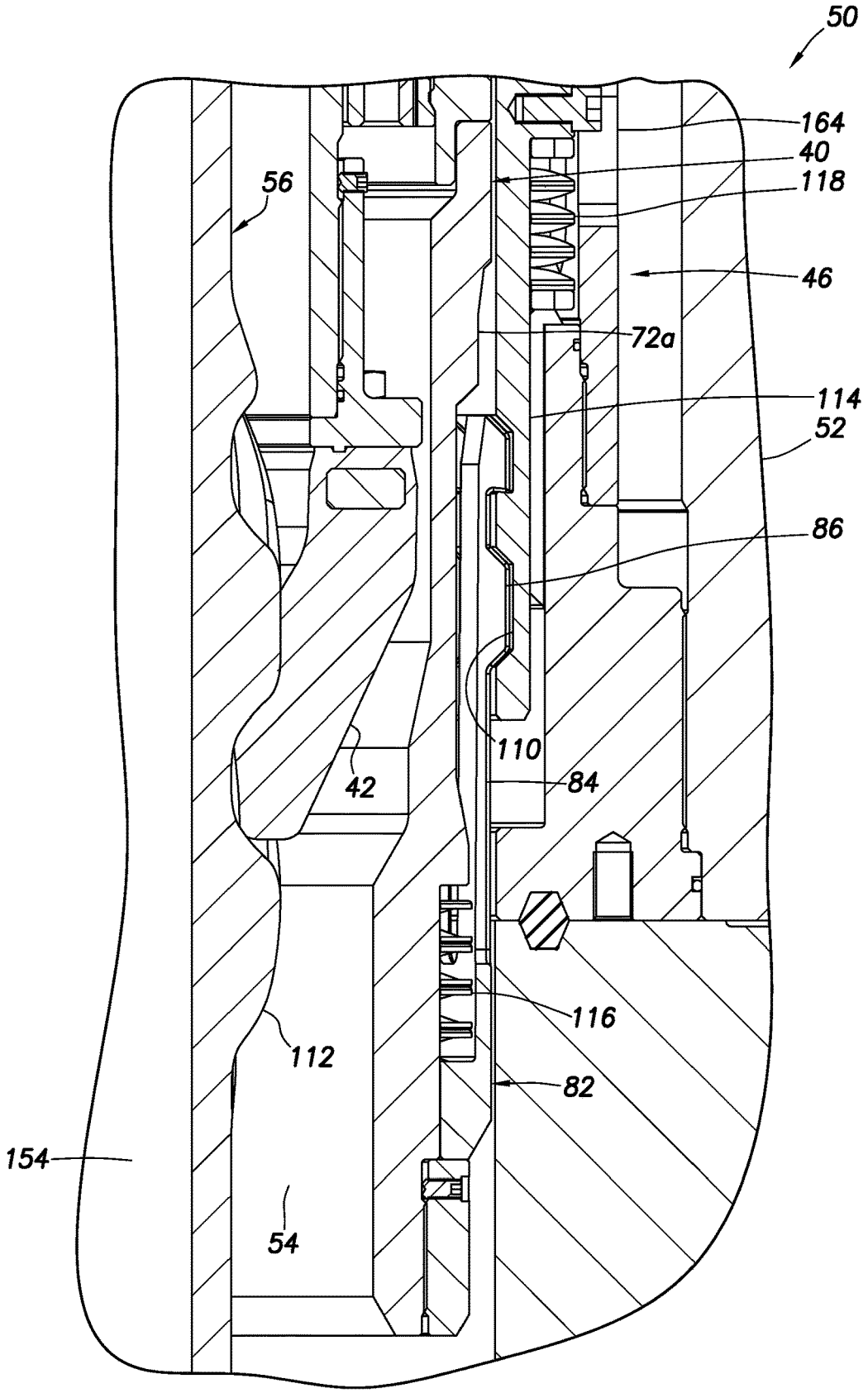
FIG. 13 is a representative enlarged scale cross-sectional view of a portion of the pressure control device.

Referring additionally now to FIG. 13, an enlarged scale cross-sectional view of a portion of the pressure control device 50 is representatively illustrated. In this view, the releasable assembly 40 has been conveyed sufficiently downward into the latch 46, so that the collet profiles 86 are now cooperatively engaged with the internal profile 110 of the latch 46.

Note that the profiles 86, 110 are appropriately configured to maintain this engagement as the releasable assembly 40 displaces further downward. Thus, further downward displacement of the releasable assembly 40 in the latch 46 will cause the collets 84 to temporarily cease downward displacement relative to the setting sleeve 114 as the spring 116 compresses. When the spring 116 has been sufficiently compressed, the collets 84 will be radially inwardly supported by the support diameter 72*a* of the releasable assembly outer housing 72, so that the profiles 86, 110 cannot be disengaged, until the releasable assembly 40 is subsequently retrieved from the latch 46.

Figure 14:
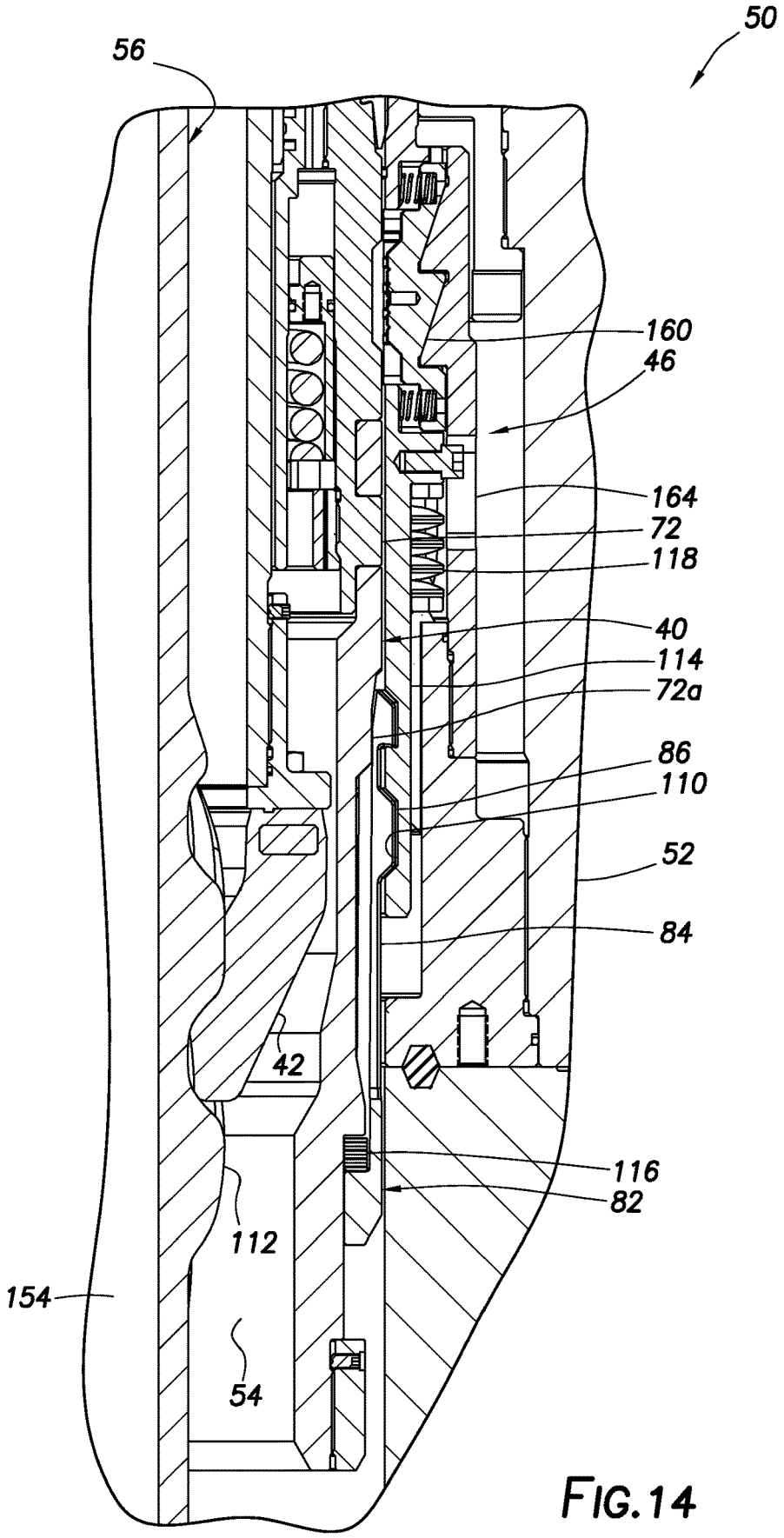
FIG. 14 is a representative cross-sectional view of a portion of the pressure control device.

Referring additionally now to FIG. 14, a cross-sectional view of a portion of the pressure control device 50 is representatively illustrated. In this view, the releasable assembly 40 has been conveyed into the latch 46 sufficiently far for the profiles 86, 110 to be engaged (as in FIG. 13), and sufficient downwardly directed force has been applied via the running tool 56 (such as, by slacking off weight on the tubular string 20 at the surface) to compress the spring 116.

Referring additionally now to FIG. 15, a cross-sectional view of a portion of the pressure control device 50 is representatively illustrated. In this view, additional downwardly directed force has been applied via the running tool 56 to the releasable assembly 40 after the collets 84 are radially inwardly supported by the support diameter 72*a*. The spring 118 is compressed by this additional downward force as the setting sleeve 114 displaces downward with the collets 84 and the remainder of the releasable assembly 40.

This downward displacement of the setting sleeve 114 causes the slips 160 to be displaced radially inward, due to the cooperating inclined surfaces formed on the slips 160 and in the slip housing 164. The slips 160 now grippingly engage a radially reduced outer surface 72*b* of the outer housing 72 of the releasable assembly 40. This gripping engagement prevents rotation of the releasable assembly 40 within the latch 46 of the pressure control device 50, and also prevents longitudinal displacement of the releasable assembly 40.

The downward displacement of the setting sleeve 114 allows the setting ring 166 to contract radially inward. Due to the cooperating conical shapes of the setting sleeve 114, the setting ring 166 and the piston 168, the radially inward contraction of the setting ring in turn allows the spring 170 to displace the piston 168 upward to its set position.

In this set position of the piston 168, the setting sleeve 114 is prevented from displacing upward. Since the setting sleeve 114 is prevented from displacing upward, the slips 160 are prevented from disengaging from the outer surface 72*b* of the releasable assembly outer housing 72. Thus, the releasable assembly 40 is now secured against both longitudinal and rotational displacement relative to the latch 46 and outer housing 52 of the pressure control device 50.

Figure 16:
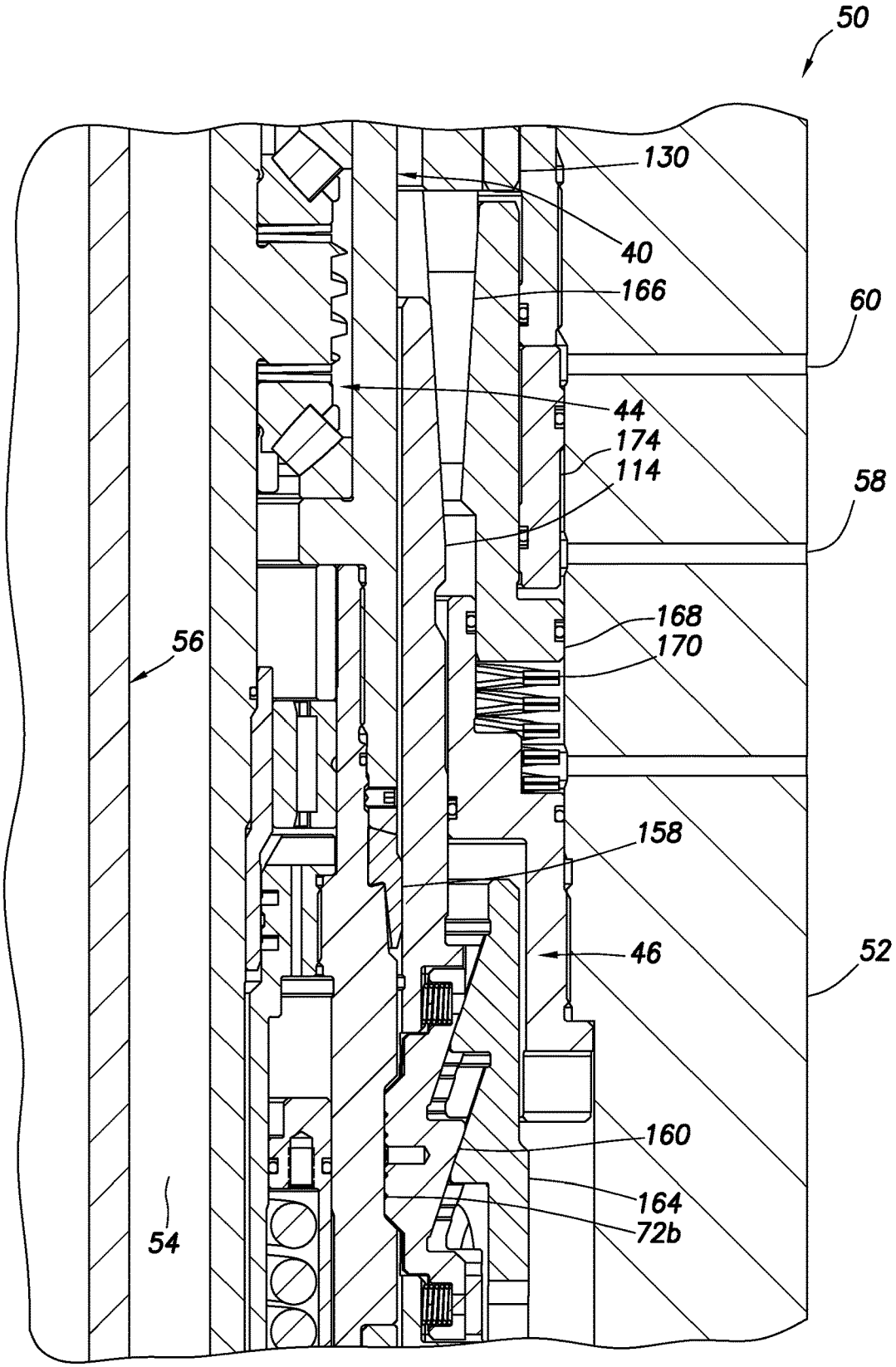
FIG. 16 is a representative enlarged scale cross-sectional view of a portion of the pressure control device.

Referring additionally now to FIG. 16, an enlarged scale cross-sectional view of a portion of the pressure control device 50 is representatively illustrated. In this view, the cooperative engagement of the conical surfaces of the setting sleeve 114, the setting ring 166 and the piston 168 in the set position of the piston can be more clearly seen.

It will be appreciated that, as long as the piston 168 is maintained in this set position by the springs 170, the setting sleeve 114 cannot displace upwardly to disengage the slips 160 from the releasable assembly 40. To displace the piston 168 downward to its unset position, increased pressure can be applied to the release port 58 (for example, using a pump on the rig 14 of FIG. 1).

If this is unsuccessful, increased pressure can also be applied to the backup release port 60 to displace an annular backup piston 174 with the piston 168 and compress the springs 170. If application of pressure to the ports 58, 60 is unsuccessful to displace the piston 168 downward, the projections 130 can be used to displace the piston 168 downward in a contingency retrieval operation, as described more fully below.

Figure 17A:
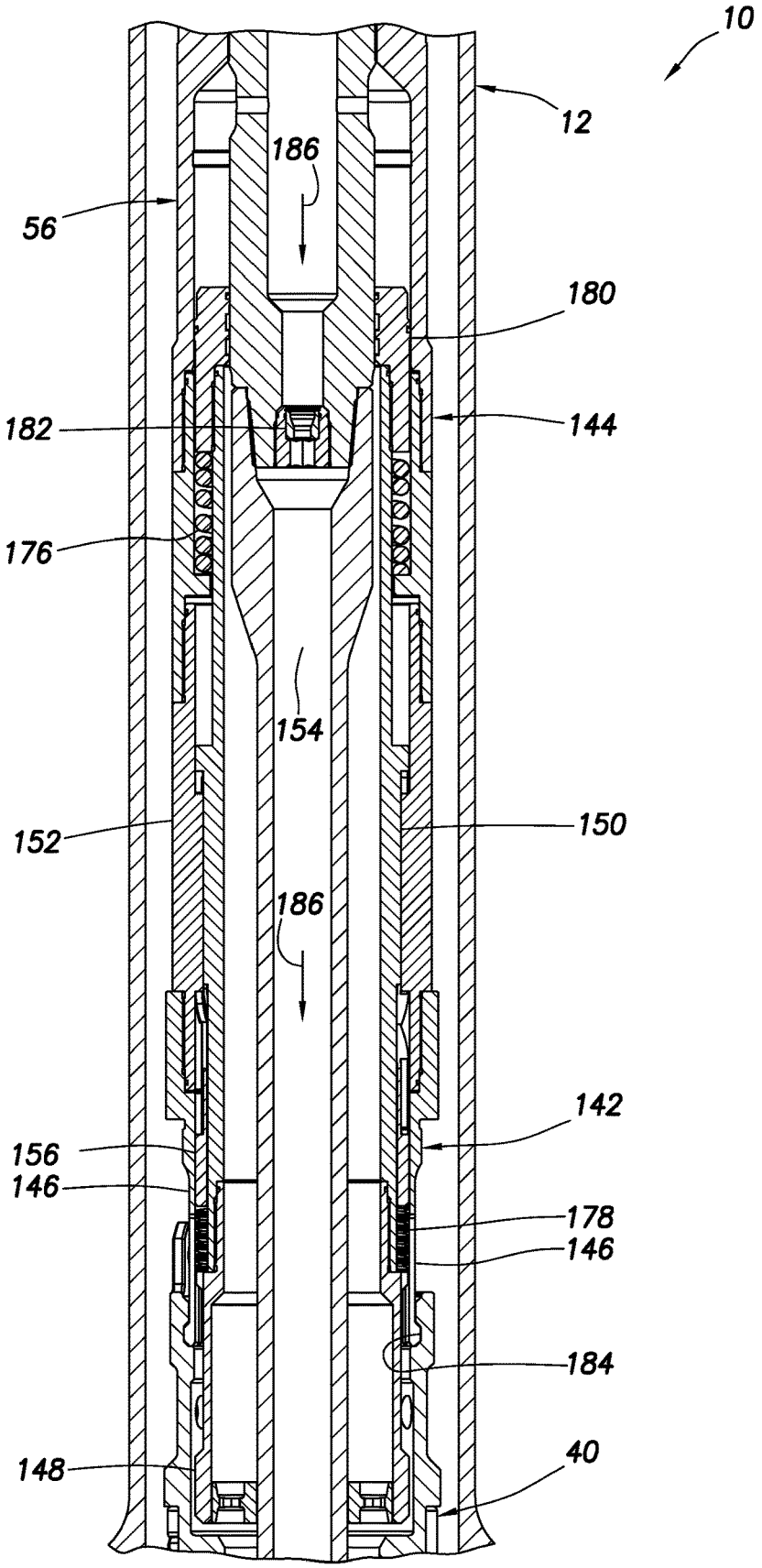
FIGS. 17A & B are representative cross-sectional views of the running tool and an upper portion of the releasable assembly in respective fluid flow rate increased and decreased configurations.

Referring additionally now to FIGS. 17A & B, the running tool 56 and an upper portion of the releasable assembly 40 are representatively illustrated in respective fluid flow rate increased and decreased configurations. These configurations can be utilized after the releasable assembly 40 has been received in the latch 46, and the latch has been set, in order to release the running tool 56 from the releasable assembly 40.

As depicted in FIG. 17A, fluid flow 186 through the running tool flow passage 154 is increased to (or above) the predetermined fluid flow rate. A sufficient pressure differential has thereby been created across the orifice 182, so that the piston 180, indexing sleeve 150 and support structure 148 are displaced downward against the biasing force exerted by the spring 176.

Figure 17B:
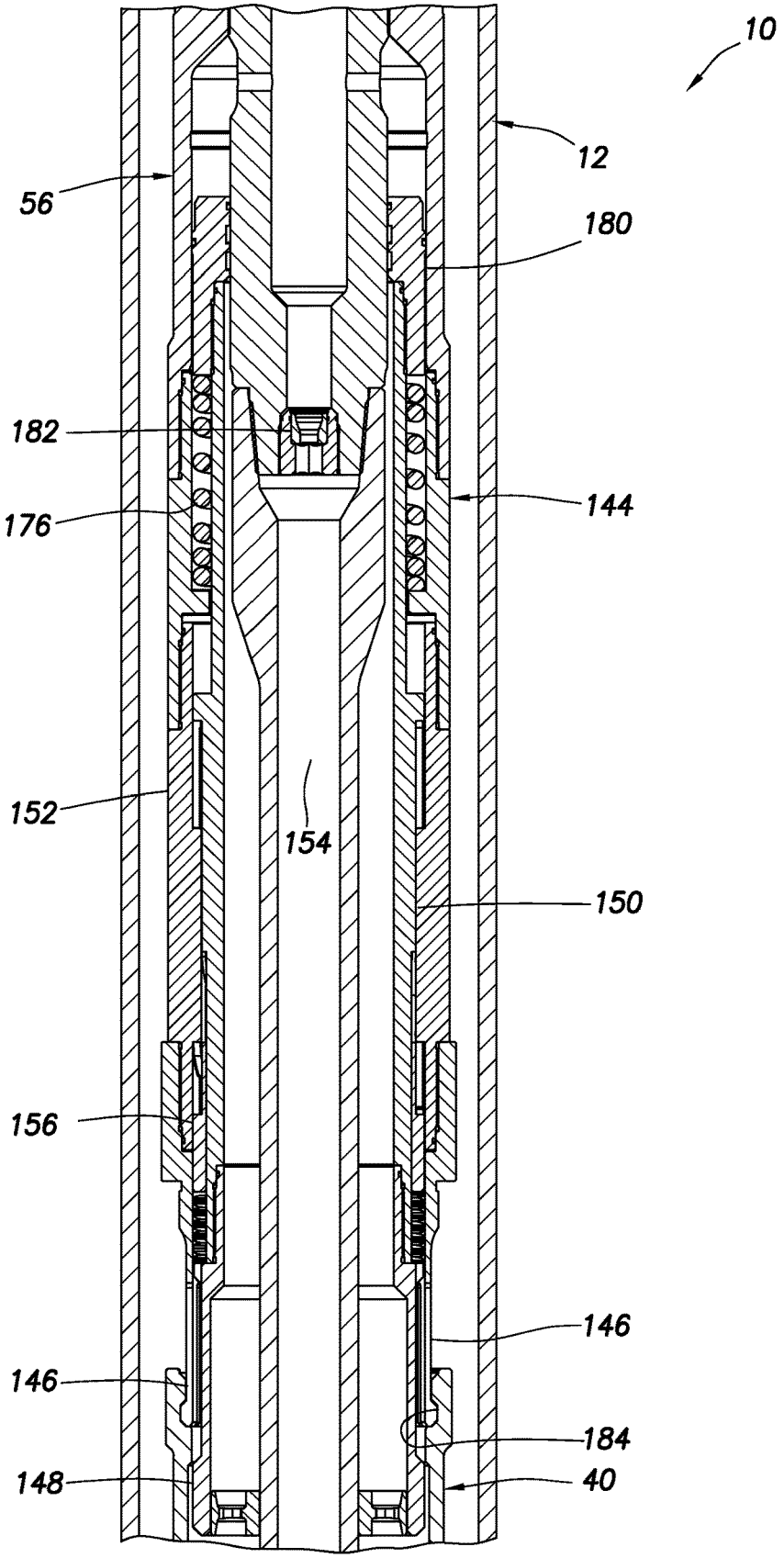

As depicted in FIG. 17B, the fluid flow 186 has subsequently been reduced (or completely removed). As a result, the pressure differential across the orifice 182 has decreased (or been eliminated), and the spring 176 has displaced the piston 180, indexing sleeve 150 and support structure 148 upward.

However, in the released configuration of FIG. 17B, the support structure 148 remains longitudinally spaced apart from the engagement members 146 and, thus, does not radially inwardly support the engagement members. The running tool 56 can now be retrieved from the riser string 12, leaving the releasable assembly 40 secured by the latch 46 in the outer housing 52 of the pressure control device 50.

Figure 18:
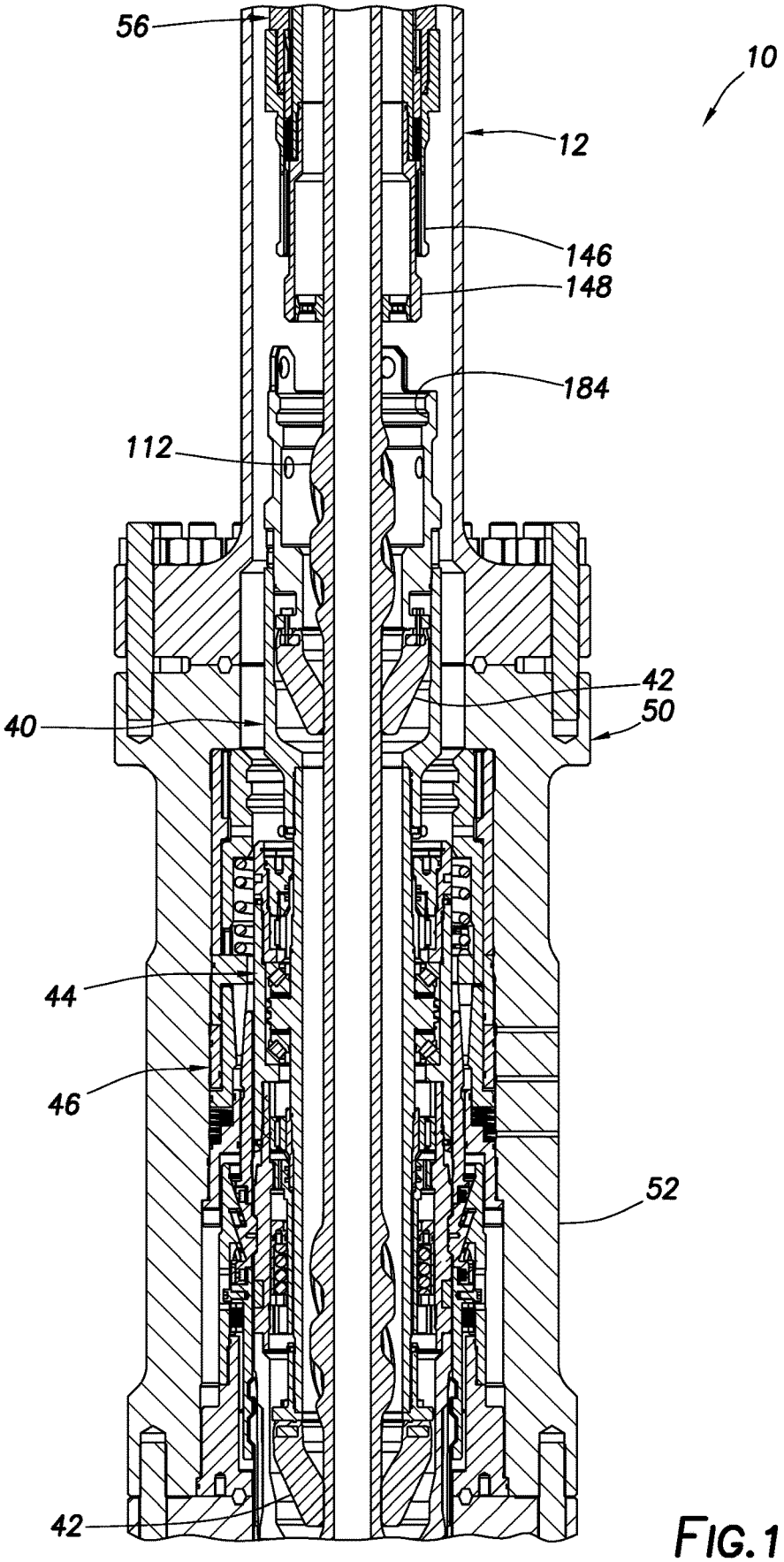
FIG. 18 is a representative cross-sectional view of the pressure control device in the system of FIG. 1.

Referring additionally now to FIG. 18, a cross-sectional view of the pressure control device 50 in the system 10 of FIG. 1 is representatively illustrated. In this view, the running tool 56 is released from the releasable assembly 40, and is being retrieved from the riser string 12.

The releasable assembly 40 remains secured by the latch 46 in the outer housing 52 of the pressure control device 50. After the running tool 56 has been retrieved, the tubular string 20 can be sealingly received in the pressure control device 50, with the annular seals 42 sealingly engaging an outer surface of the tubular string 20 to seal off an annular space between the tubular string and the releasable assembly (as depicted in FIG. 2).

Figure 19A:
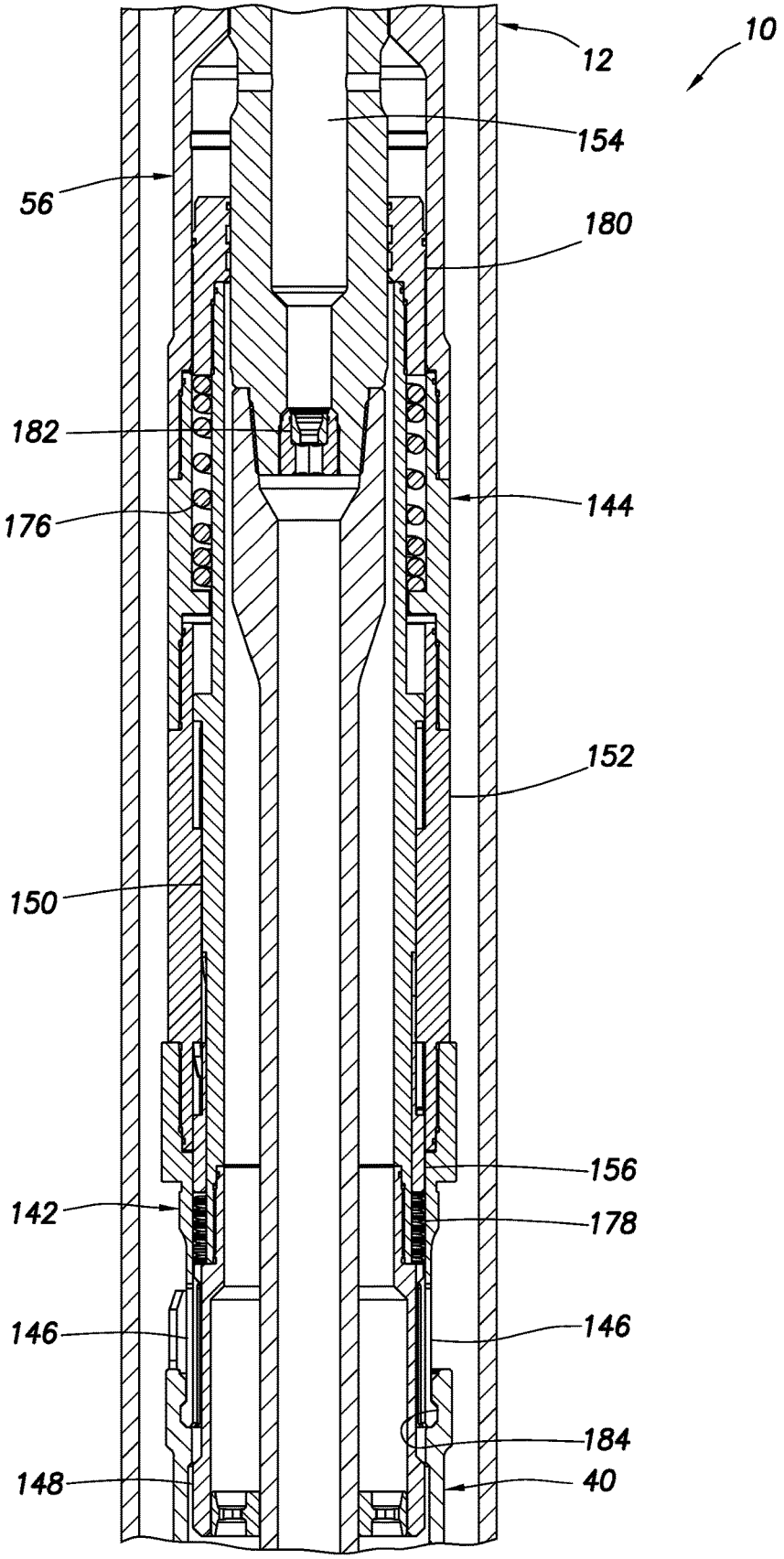
FIGS. 19A-C are representative cross-sectional views of the running tool and the releasable assembly in the system.
Figure 19B:
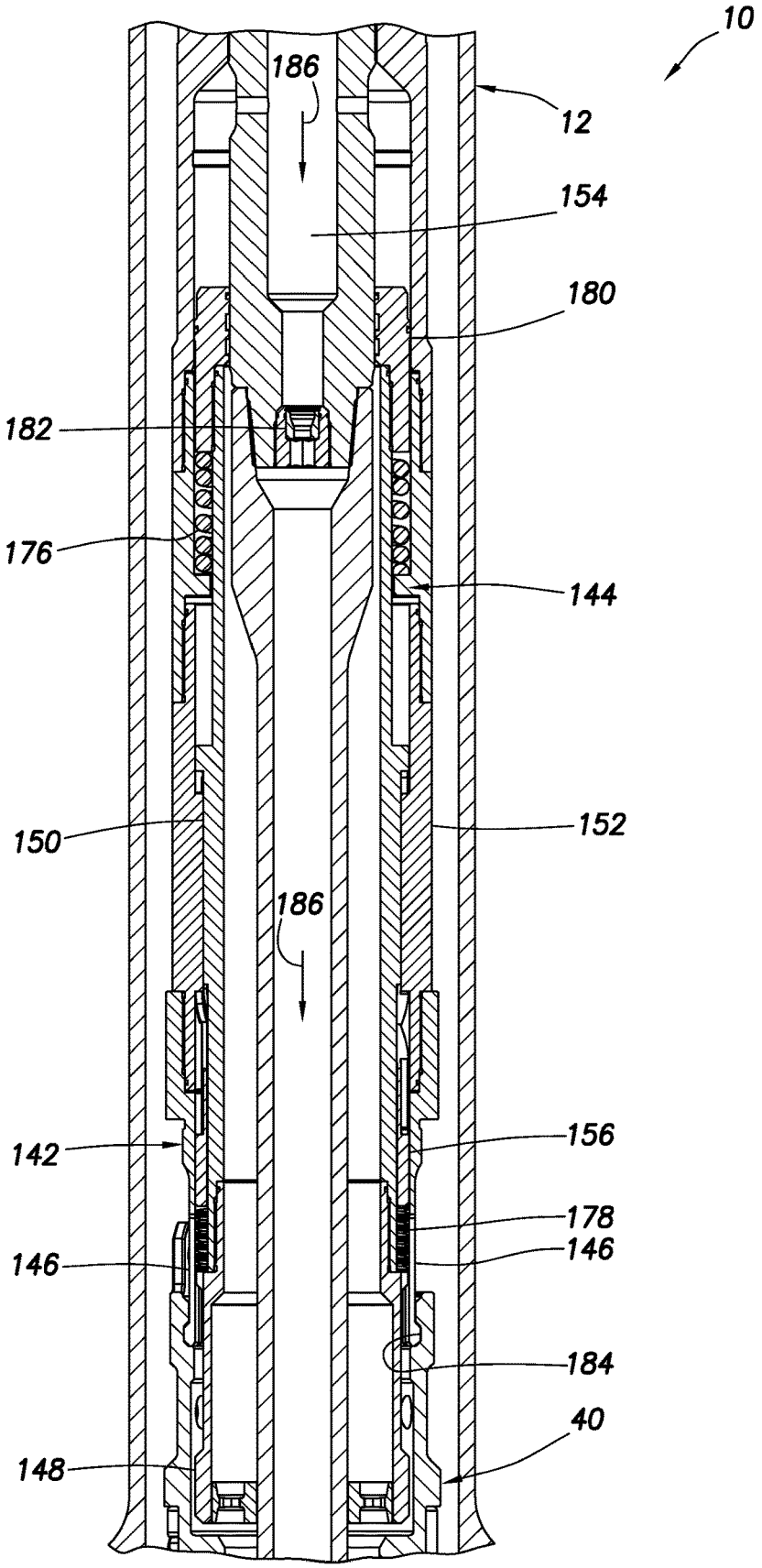
Figure 19C:
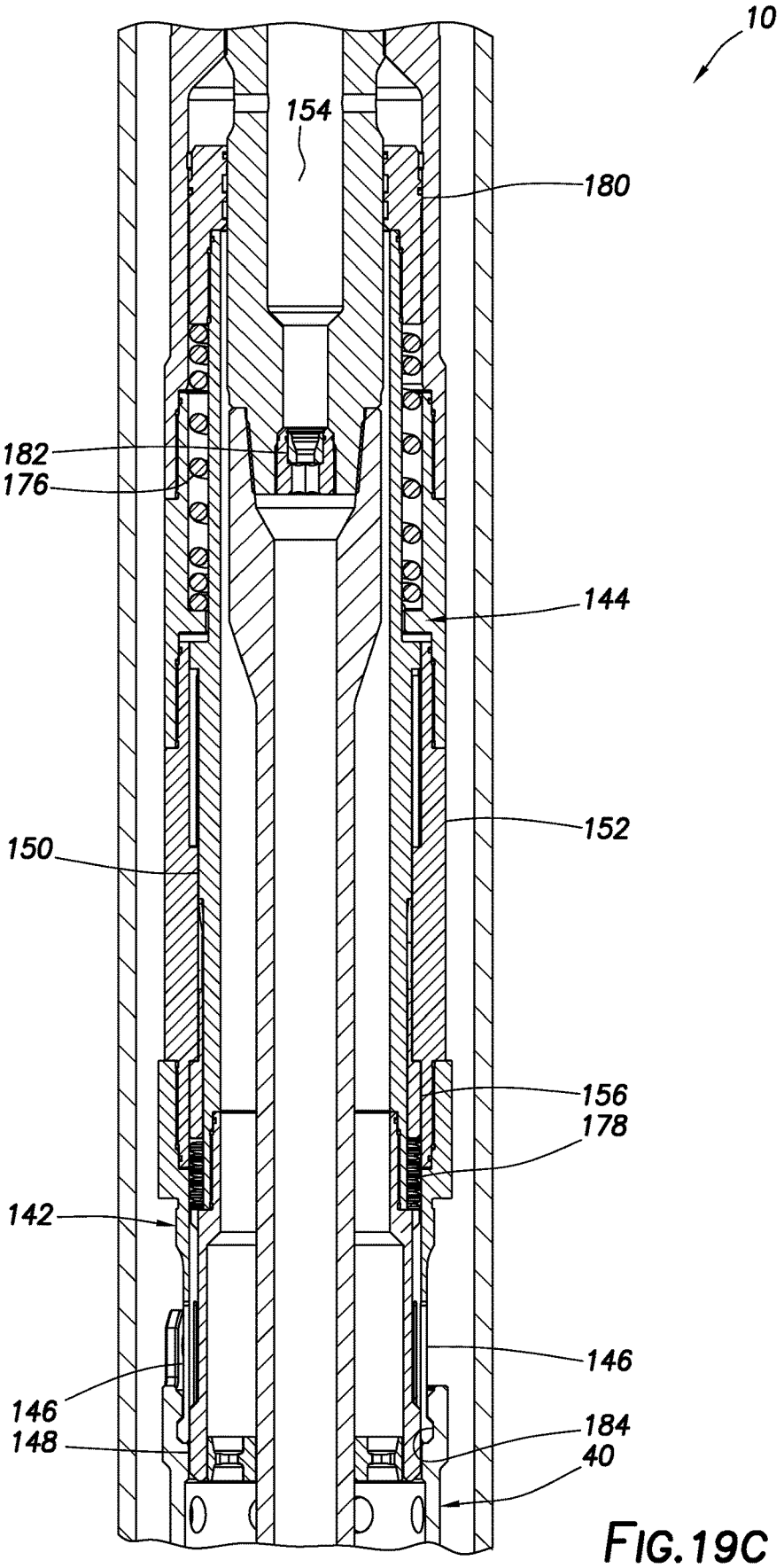

Referring additionally now to FIGS. 19A-C, cross-sectional views of the running tool 56 and the releasable assembly 40 in the system 10 are representatively illustrated. In these views, the running tool 56 is being used to retrieve the releasable assembly 40, after the releasable assembly was previously installed and secured in the latch 46 and outer housing 52 of the pressure control device 50.

In FIG. 19A, the running tool 56 has been displaced downward through the riser string 12, so that the engagement members 146 are now engaged with the internal profile 184 in the upper end of the releasable assembly 40. However, the support structure 148 is longitudinally spaced apart from the engagement members 146, so that the engagement members 146 are not yet radially inwardly supported.

In FIG. 19B, fluid flow 186 through the passage 154 is increased to at least the predetermined fluid flow rate, so that a sufficient pressure differential is produced across the orifice 182 to cause the piston 180, indexing sleeve 150 and support structure 148 to displace downward against the biasing force exerted by the spring 176.

In FIG. 19C, the fluid flow 186 through the passage 154 has been decreased (or completely eliminated), so that the spring 176 has displaced the piston 180, indexing sleeve 150 and support structure 148 upward. Due to the operation of the index mechanism 144, the support structure 148 now radially inwardly supports the engagement members 146 in engagement with the profile 184. The running tool 56 is now secured to the releasable assembly 40.

Figure 20:
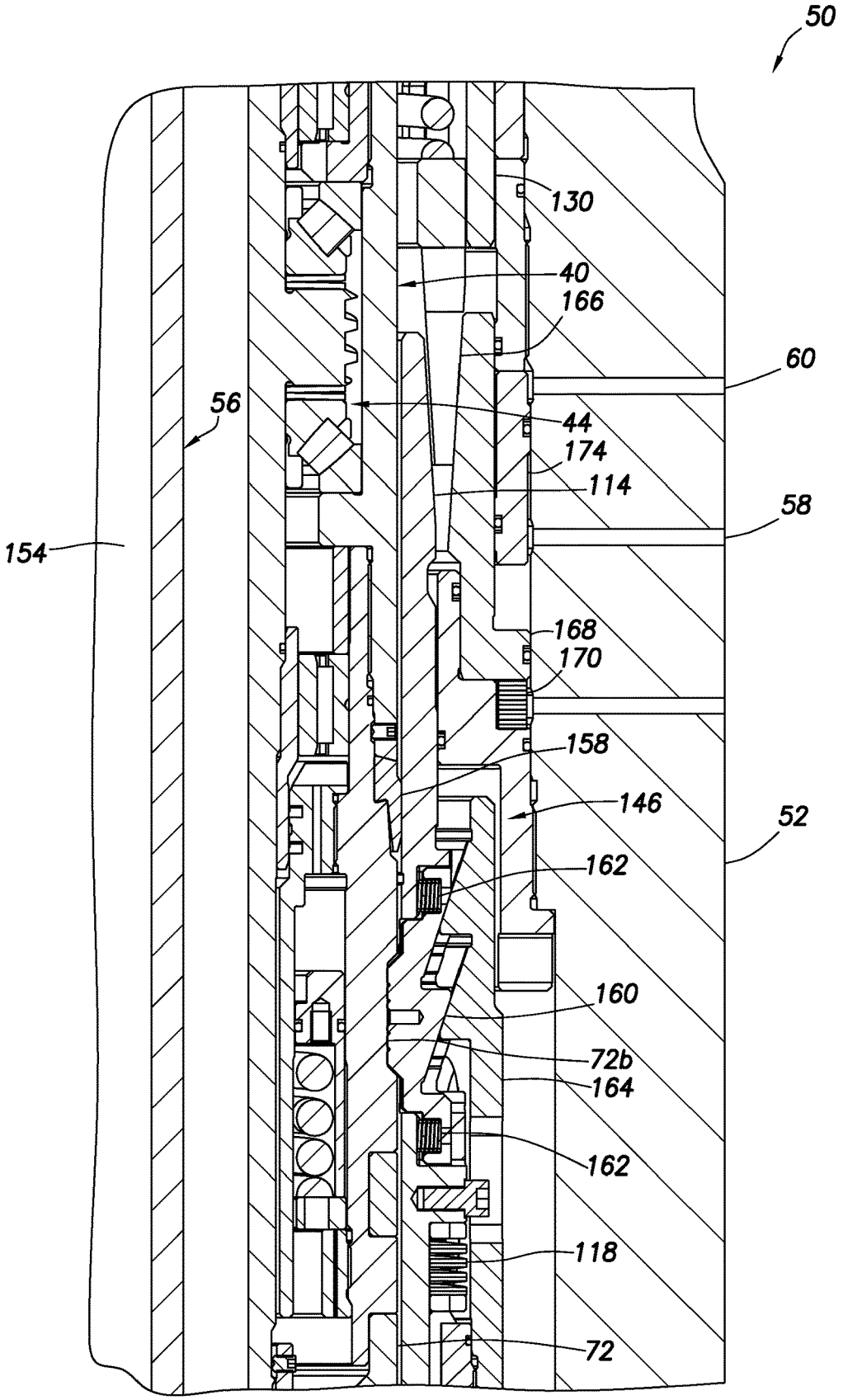
FIG. 20 is a representative enlarged scale cross-sectional view of a portion of the pressure control device.

Referring additionally now to FIG. 20, an enlarged scale cross-sectional view of a portion of the pressure control device 50 is representatively illustrated. In this view, increased pressure has been applied to the release port 58, to thereby cause the piston 168 to displace downward to its unset position against the biasing force exerted by the spring 170. As mentioned above, if the pressure applied to the release port 58 does not accomplish downward displacement of the piston 168 to its unset position, increased pressure can be applied to the backup release port 60 to downwardly displace the backup piston 174 with the piston 168.

Note that the downward displacement of the piston 168 as depicted in FIG. 20 allows the setting ring 166 to expand radially outward. Such expansion of the setting ring 166 in turn allows the setting sleeve 114 to displace upward due to the biasing force exerted by the spring 118. Upward displacement of the setting sleeve 114 will allow the springs 162 to retract the slips 160 out of engagement with the outer surface 72*b* of the releasable assembly outer housing 72, thereby unsetting the latch 46 and releasing the releasable assembly 40 for retrieval by the running tool 56.

Figure 21A:
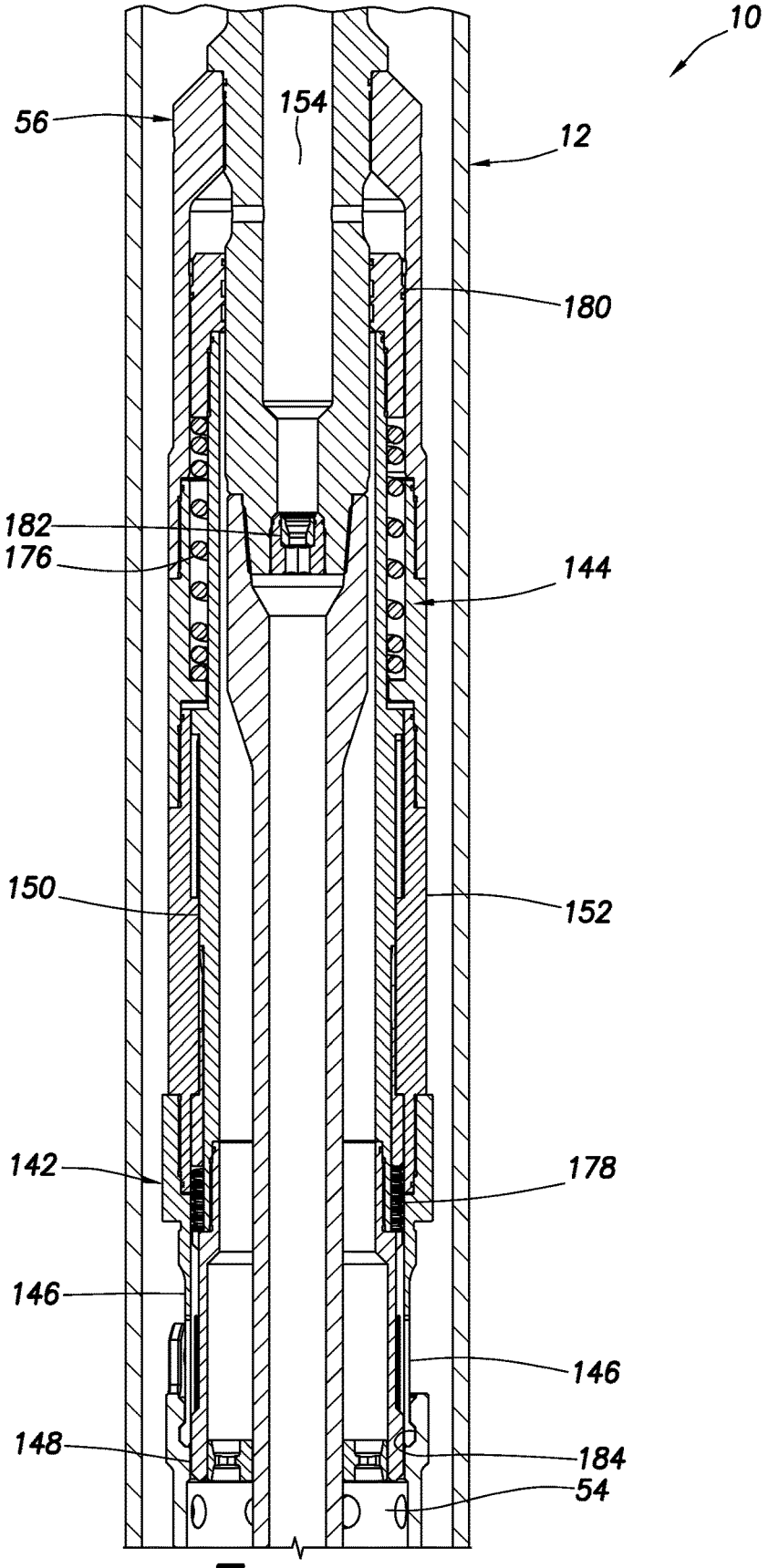
FIGS. 21A-C are representative cross-sectional views of successive longitudinal sections of the running tool and pressure control device.
Figure 21B:
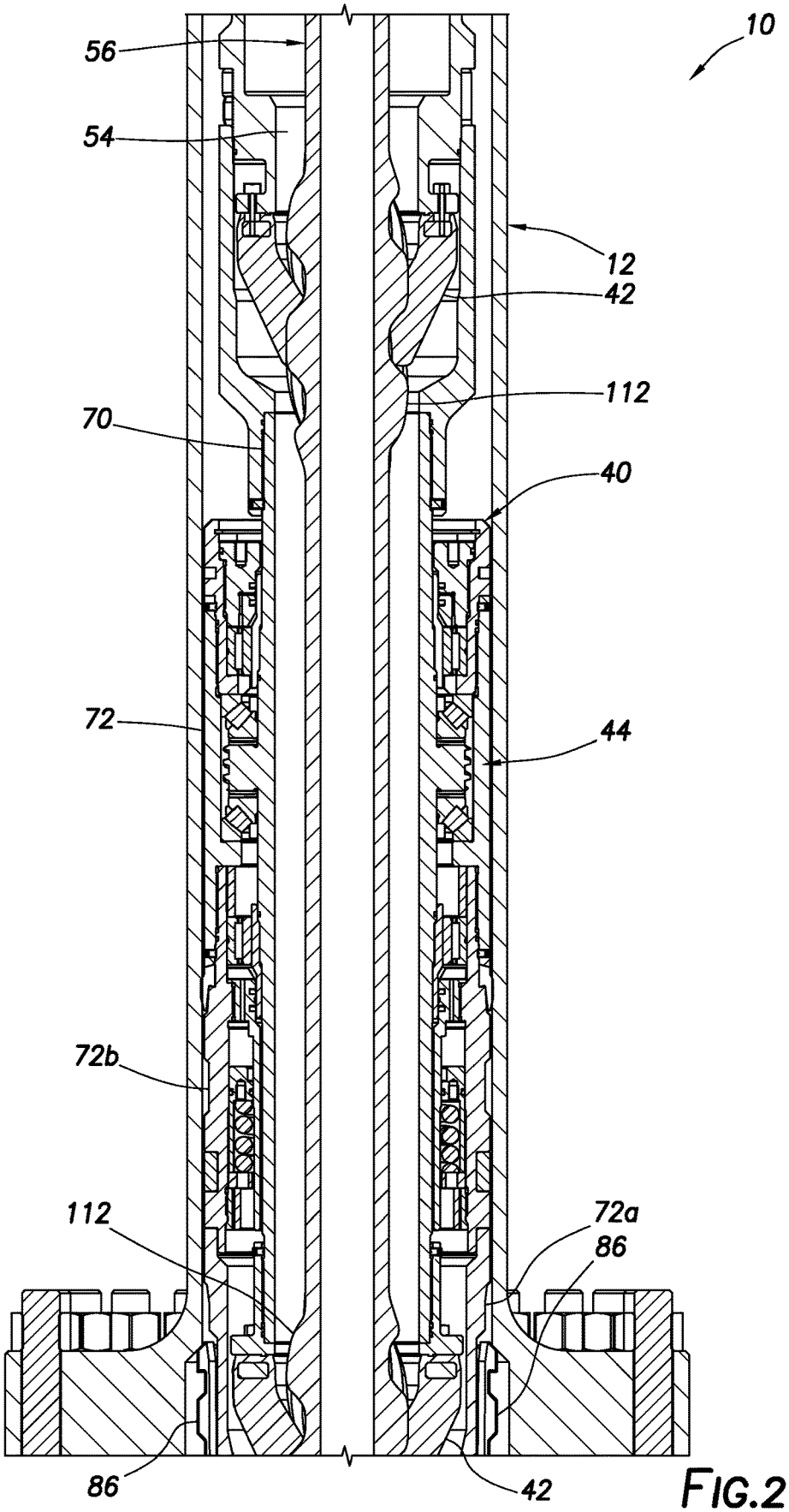
Figure 21C:
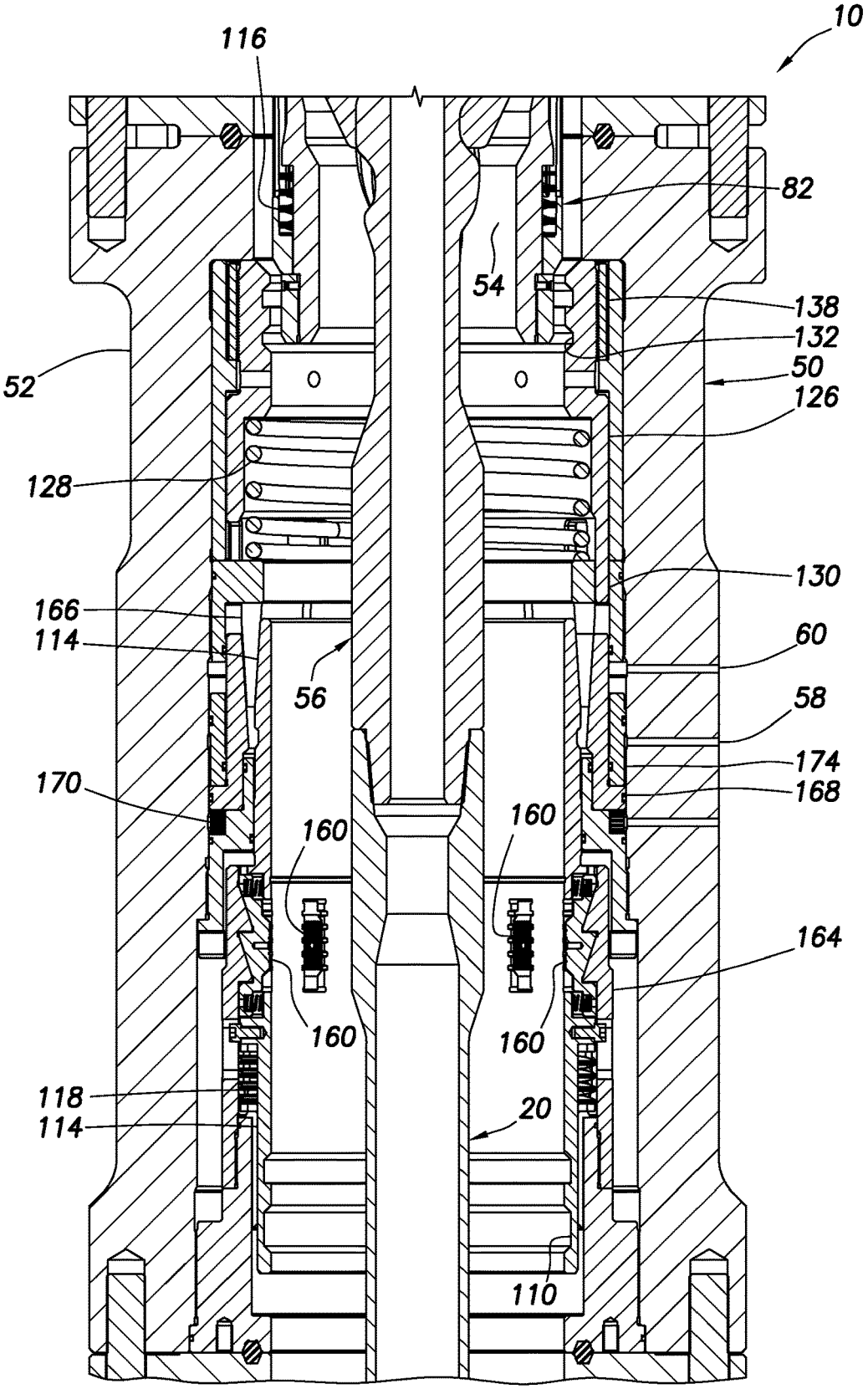

Referring additionally now to FIGS. 21A-C, cross-sectional views of successive longitudinal sections of the running tool 56 and pressure control device 50 are representatively illustrated. In these views, the running tool 56 is depicted retrieving the releasable assembly 40 from the latch 46 and outer housing 52 of the pressure control device 50 in the system 10 of FIG. 1.

As depicted in FIG. 21C, the piston 168 has been displaced downward to its unset position, the setting ring 166 has expanded radially outward, and the setting sleeve 114 has displaced upward to retract the slips 160 out of engagement with the outer surface 72*b* of the releasable assembly outer housing 72. Note that a downwardly directed force can be applied to the releasable assembly 40 via the running tool 56 (e.g., by slacking off weight on the tubular string 20 at the surface) prior to displacing the piston 168 to its unset position, so that, when the slips 160 are retracted out of engagement with the releasable assembly 40, the releasable assembly will remain stationary (and will not displace, for example, due to any residual pressure differential present across the releasable assembly).

As depicted in FIG. 21A, since the engagement members 146 are locked in engagement with the internal profile 184 of the releasable assembly 40 by the support structure 148 of the lock mechanism 142, the running tool 56 is secured to the releasable assembly 40. The running tool 56 can now convey the releasable assembly 40 to the surface through the riser string 12.

Figure 22:
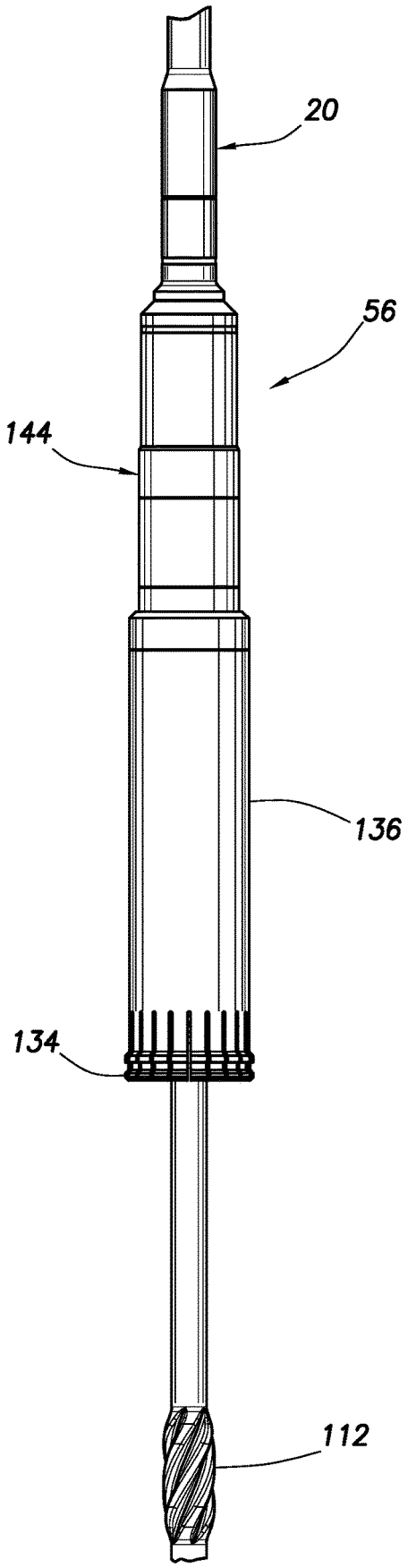
FIG. 22 is a representative elevational view of an example of the running tool equipped with a contingency retrieval tool for use in a contingency retrieval operation.

As mentioned above, in the event that the piston 168 cannot be displaced downward to its unset position by application of increased pressure to the release port 58 and the backup release port 60, a contingency retrieval operation can be used. Representatively illustrated in FIG. 22 is an example of the running tool 56 equipped with the contingency retrieval tool 136 for use in the contingency retrieval operation.

Figure 23:
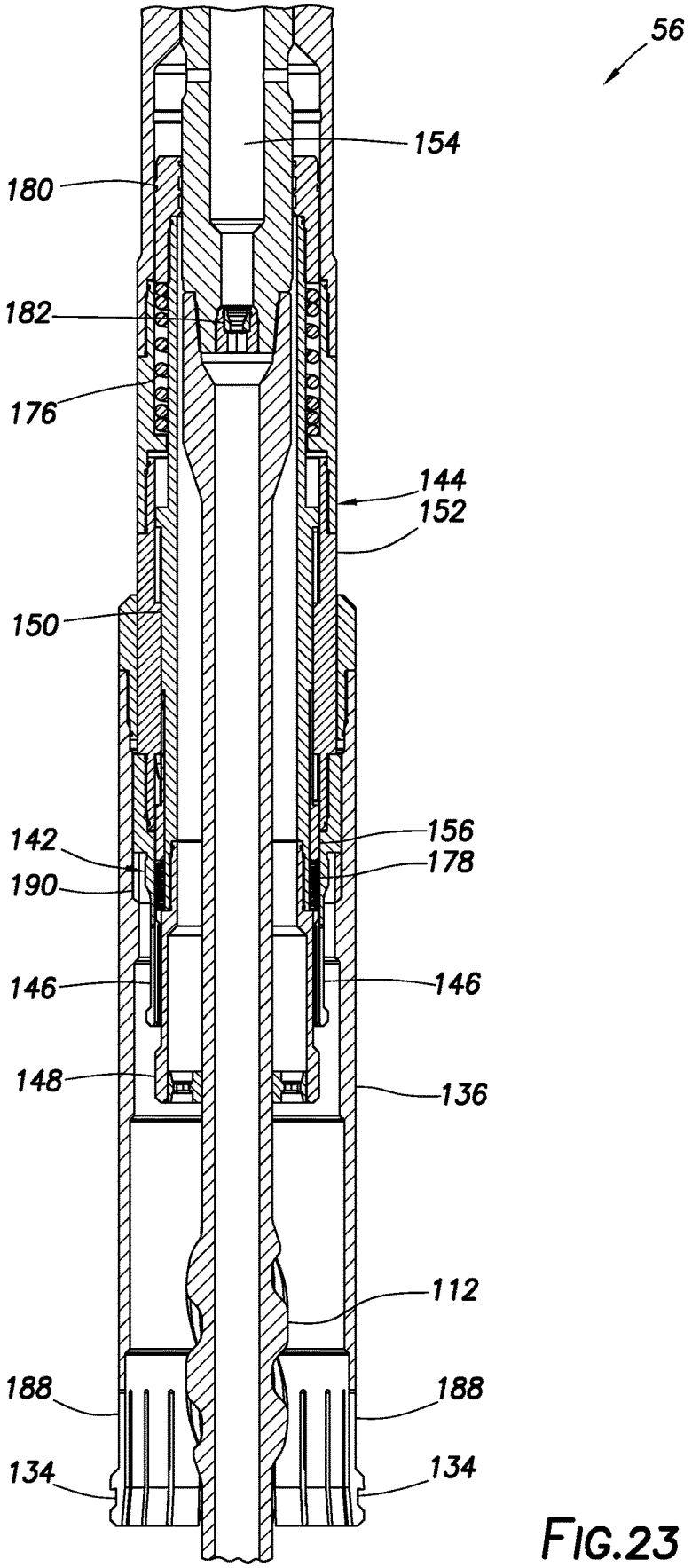
FIG. 23 is a representative cross-sectional view of the running tool with the contingency retrieval tool.

Referring additionally now to FIG. 23, a cross-sectional view of the running tool 56 with the contingency retrieval tool 136 is representatively illustrated. In this view, it may be seen that the retrieval tool 136 can be connected to the lock mechanism 142, so that resilient collets 188 having the external profiles 134 formed thereon extend downward from the lock mechanism 142.

A collapsible sleeve 190 initially prevents downward displacement of the lock mechanism 142 relative to the contingency retrieval tool 136. As depicted in FIG. 23, the collapsible sleeve 190 may be in the form of a generally C-shaped ring positioned between shoulders on the lock mechanism 142 and in the contingency retrieval tool 136. While conveying the running tool 56 with the contingency retrieval tool 136 into initial engagement with the latch 46 profile 132, the collapsible sleeve 190 prevents the engagement members 146 from engaging the profile 184 in the releasable assembly 40.

Figure 24:
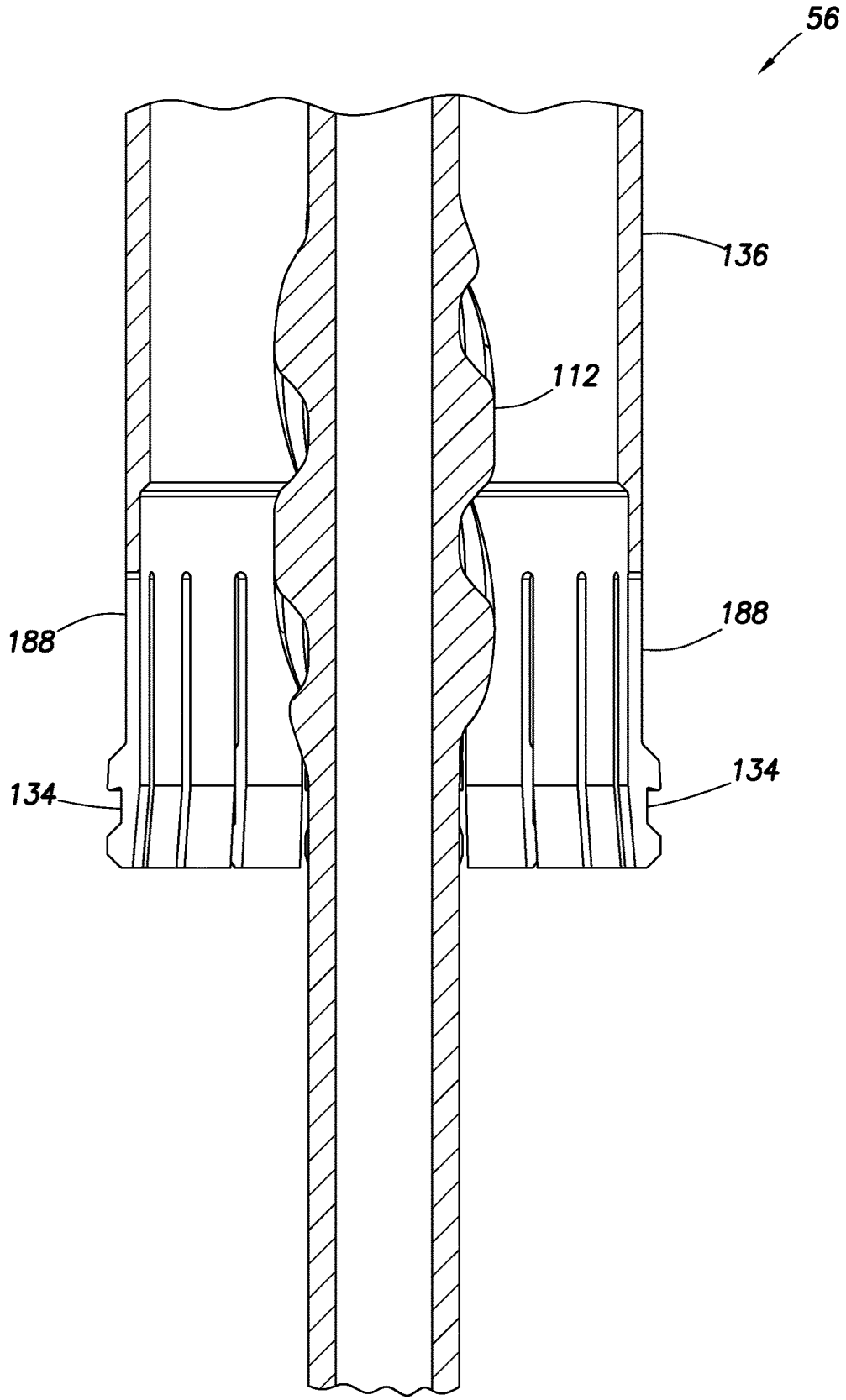
FIG. 24 is a representative enlarged scale cross-sectional view of a portion of the running tool.

Referring additionally now to FIG. 24, an enlarged scale cross-sectional view of a portion of the running tool 56 is representatively illustrated. In this view, it may be seen that the collets 188 are not inwardly supported, but are instead permitted to deflect radially inwardly. In this manner, the collets 188 can pass through any restrictions and obstructions in the riser string 12 as the running tool 56 with the contingency retrieval tool 136 is displaced downward into engagement with the releasable assembly 40.

Figure 25:
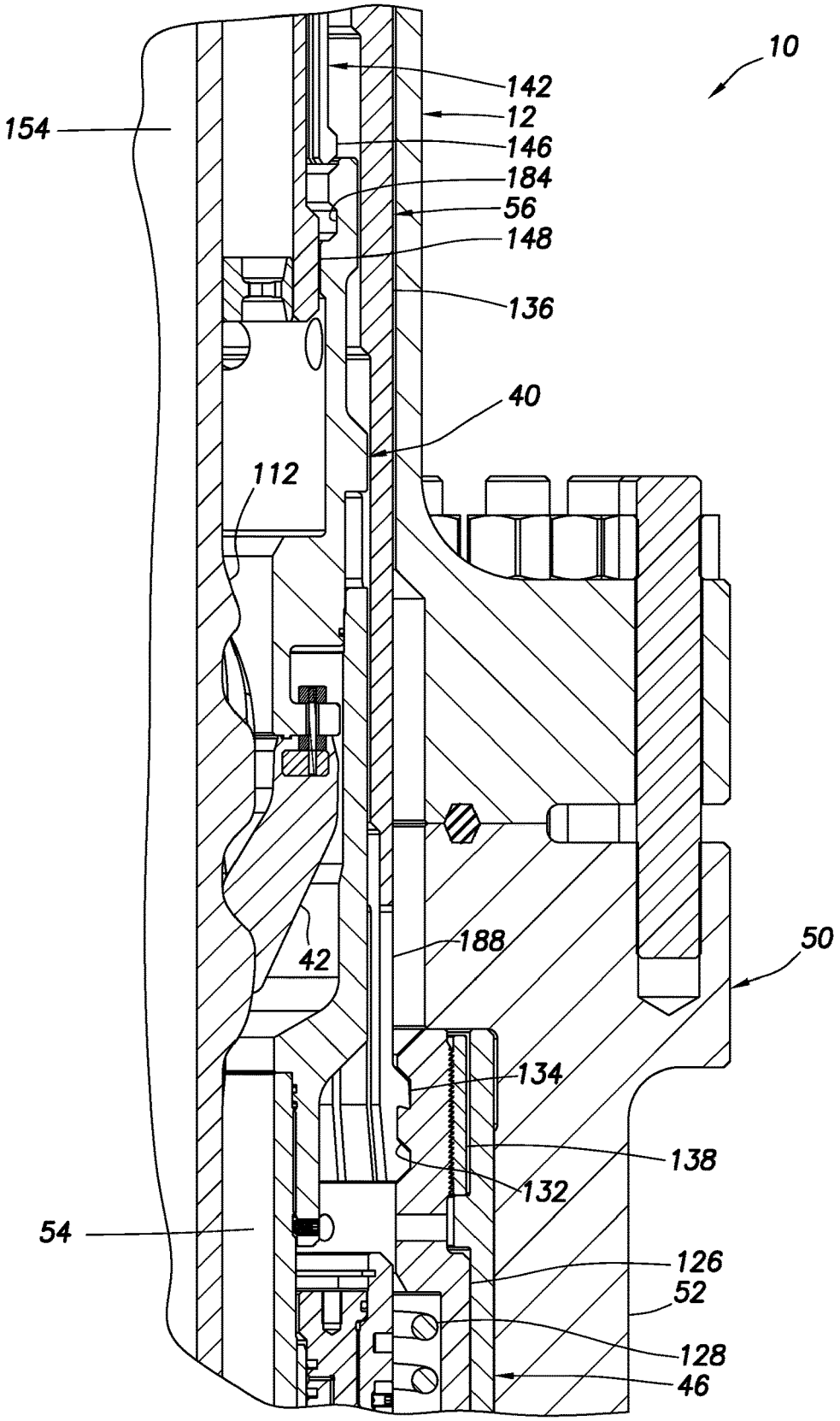
FIG. 25 is a representative cross-sectional view of portions of the running tool and pressure control device.

Referring additionally now to FIG. 25, a cross-sectional view of portions of the running tool 56 and pressure control device 50 is representatively illustrated. In this view, the running tool 56 with the contingency release tool 136 has been displaced downward through the riser string 12, until the external profiles 134 on the collets 188 have cooperatively engaged the internal profile 132 in the release sleeve 126 of the latch 46. Note that the profiles 132, 134 are configured so that, after their engagement, a downwardly directed force can be transmitted from the running tool 56 to the release sleeve 126, for example, by slacking off on the tubular string 20 at the surface.

Figure 26:
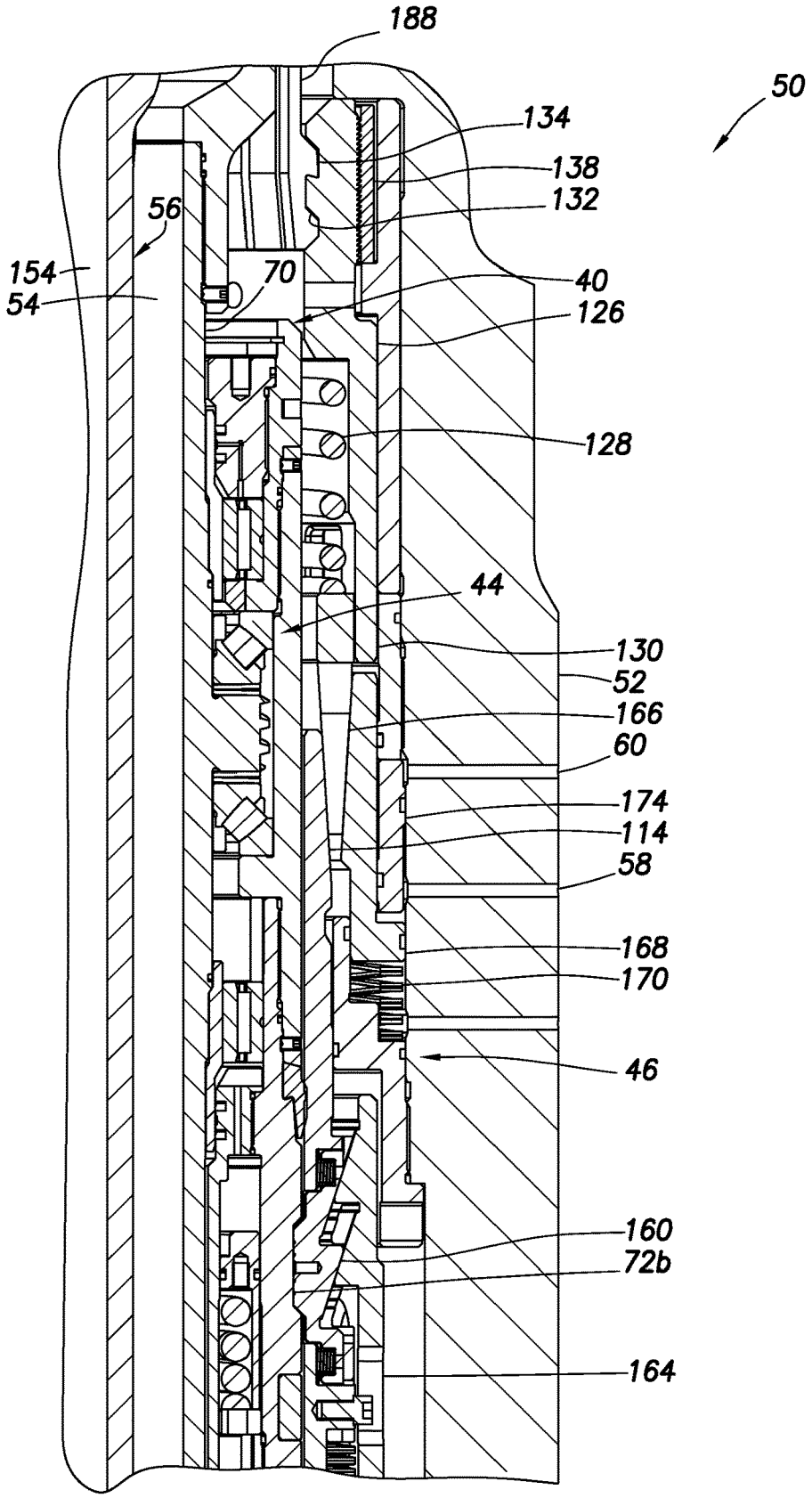
FIG. 26 is a representative cross-sectional view of portions of the running tool and the pressure control device.

Referring additionally now to FIG. 26, a cross-sectional view of portions of the running tool 56 and the pressure control device 50 is representatively illustrated. In this view, it may be seen that, with the profiles 132, 134 cooperatively engaged, the release sleeve 126 can be downwardly displaced by downward displacement of the running tool 56. Since the projections 130 on the release sleeve 126 are longitudinally aligned with an upper end of the piston 168, such downward displacement of the release sleeve 126 will cause the projections 130 to contact and downwardly displace the piston 168.

Figure 27:
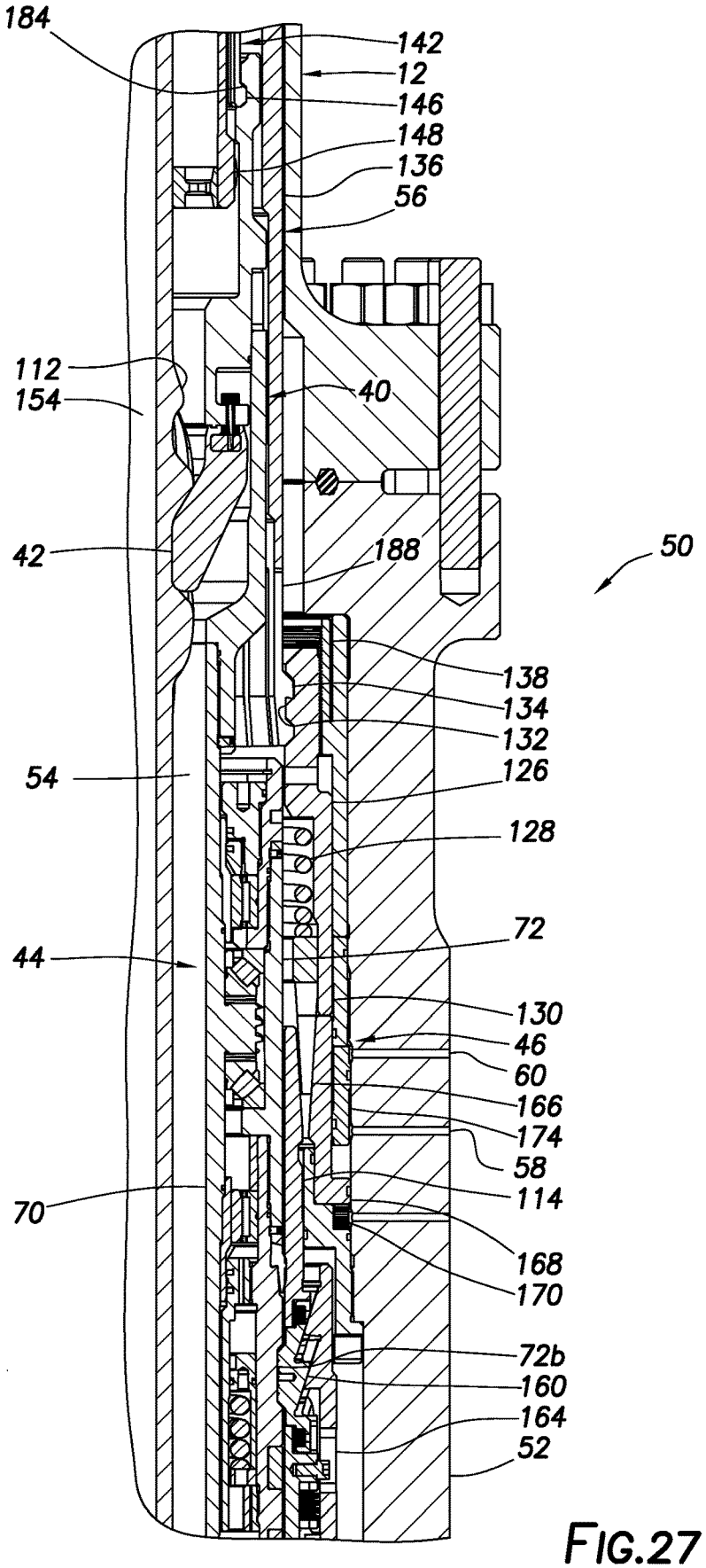
FIG. 27 is a representative cross-sectional view of portions of the pressure control device and running tool.

Referring additionally now to FIG. 27, a cross-sectional view of portions of the pressure control device 50 and running tool 56 is representatively illustrated. In this view, a downwardly directed force has been applied to the release sleeve 126 via the running tool 56 (e.g., by slacking off on the tubular string 20 at the surface), so that the release sleeve 126 is displaced downward against the biasing force exerted by the spring 128. This downwardly directed force is also sufficient to cause the collapsible sleeve 190 to collapse radially inward (see FIGS. 28A & B). As a result, the projections 130 have contacted and displaced the piston 168 downward to its unset position.

With the piston 168 in its unset position, the setting ring 166 can now expand radially, thereby allowing the setting sleeve 114 to displace upward to retract the slips 160 out of engagement with the outer surface 72*b* of the releasable assembly 40. This is similar to the procedure described above in relation to FIGS. 20 & 21A-C. Note that the lock ring 138 maintains the release sleeve 126 in its downwardly displaced position (which maintains the piston 168 in its unset position as depicted in FIG. 27) for the remainder of the contingency retrieval operation.

Figure 28A:
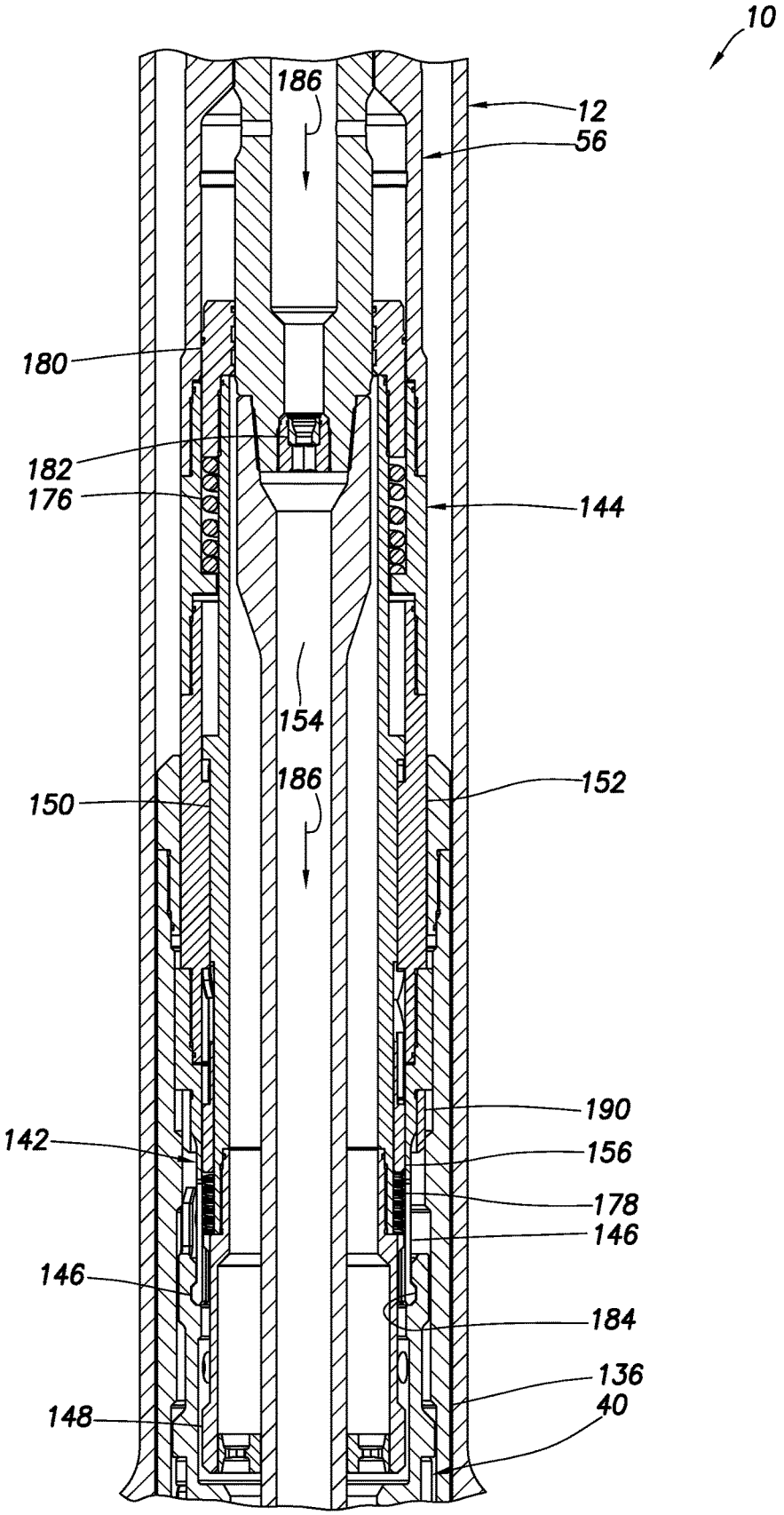
FIGS. 28A & B are representative cross-sectional views of the running tool engaged with an internal profile of the releasable assembly.

Referring additionally now to FIGS. 28A & B, a cross-sectional view of the running tool 56 engaged with the internal profile 184 of the releasable assembly 40 is representatively illustrated, after the release sleeve 126 has been displaced downward as described above. Note that the collapsible sleeve 190 is compressed radially inward, thereby allowing the engagement members 146 to displace downward and engage the internal profile 184.

In FIG. 28A, fluid flow 186 through the passage 154 is increased to at least the predetermined fluid flow rate, so that a sufficient pressure differential is produced across the orifice 182 to downwardly displace the piston 180, indexing sleeve 150 and support structure 148 against the biasing force exerted by the spring 176.

Figure 28B:
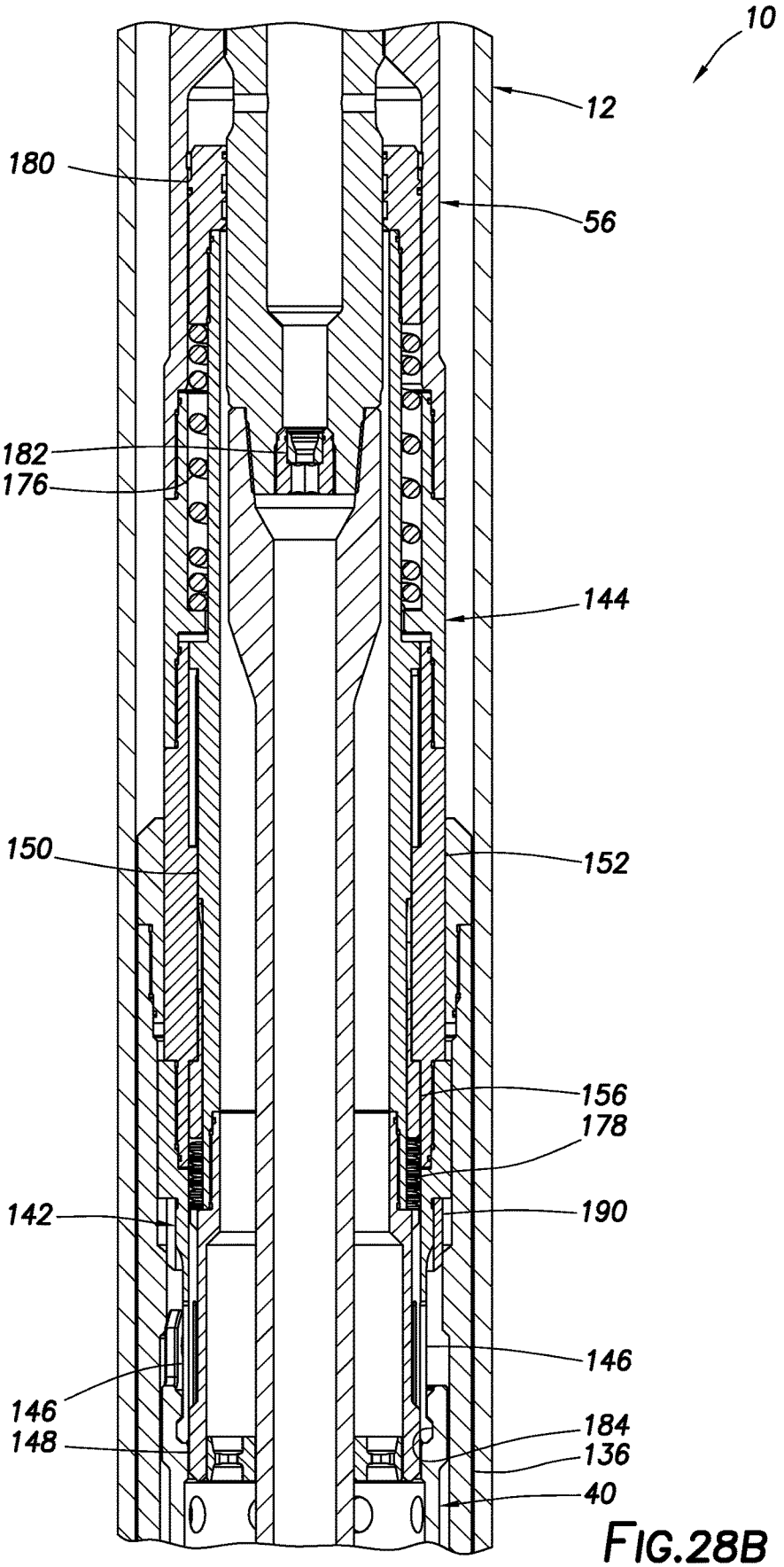

In FIG. 28B, the fluid flow 186 is decreased (or completely eliminated), so that the spring 176 has displaced the piston 180, indexing sleeve 150 and support structure 148 upward. Due to the operation of the index mechanism 144, the support structure 148 is displaced to a position in which it radially inwardly supports the engagement members 146 in cooperative engagement with the internal profile 184 of the releasable assembly 40. The running tool 56 is now secured to the releasable assembly 40, and the running tool 56 can convey the releasable assembly 40 to the surface through the riser string 12.

Figure 29A:
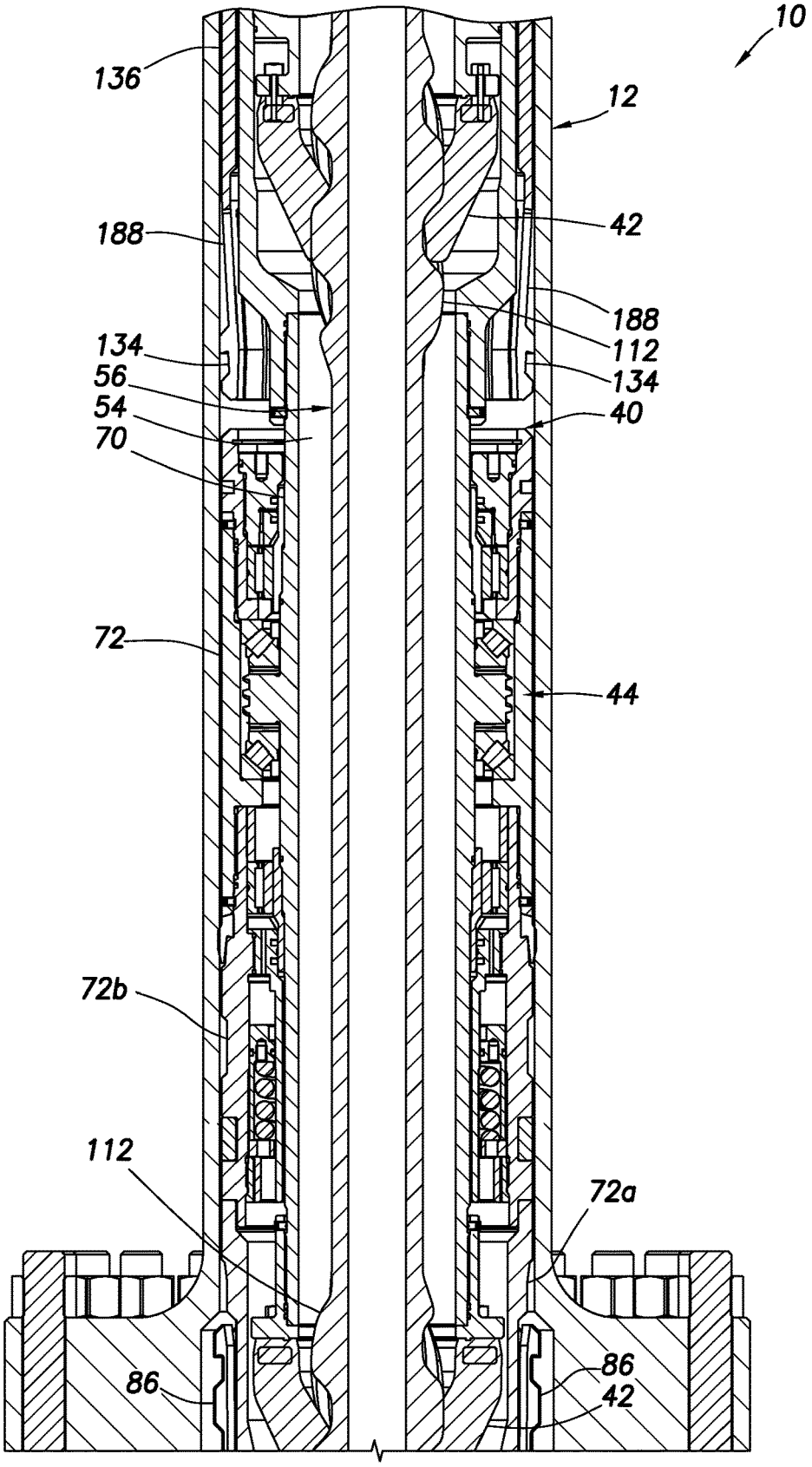
FIGS. 29A & B are representative cross-sectional views of successive longitudinal sections of the running tool and pressure control device.

Referring additionally now to FIGS. 29A & B, cross-sectional views of successive longitudinal sections of the running tool 56 and pressure control device 50 are representatively illustrated. In these views, the running tool 56 with the contingency release tool 136 is conveying the releasable assembly 40 to the surface through the riser string 12. Note that the collets 134 are no longer engaged with the internal profile 132, and are able to deflect radially inward as the running tool 56 is displaced upward through the riser string 12.

Figure 29B:
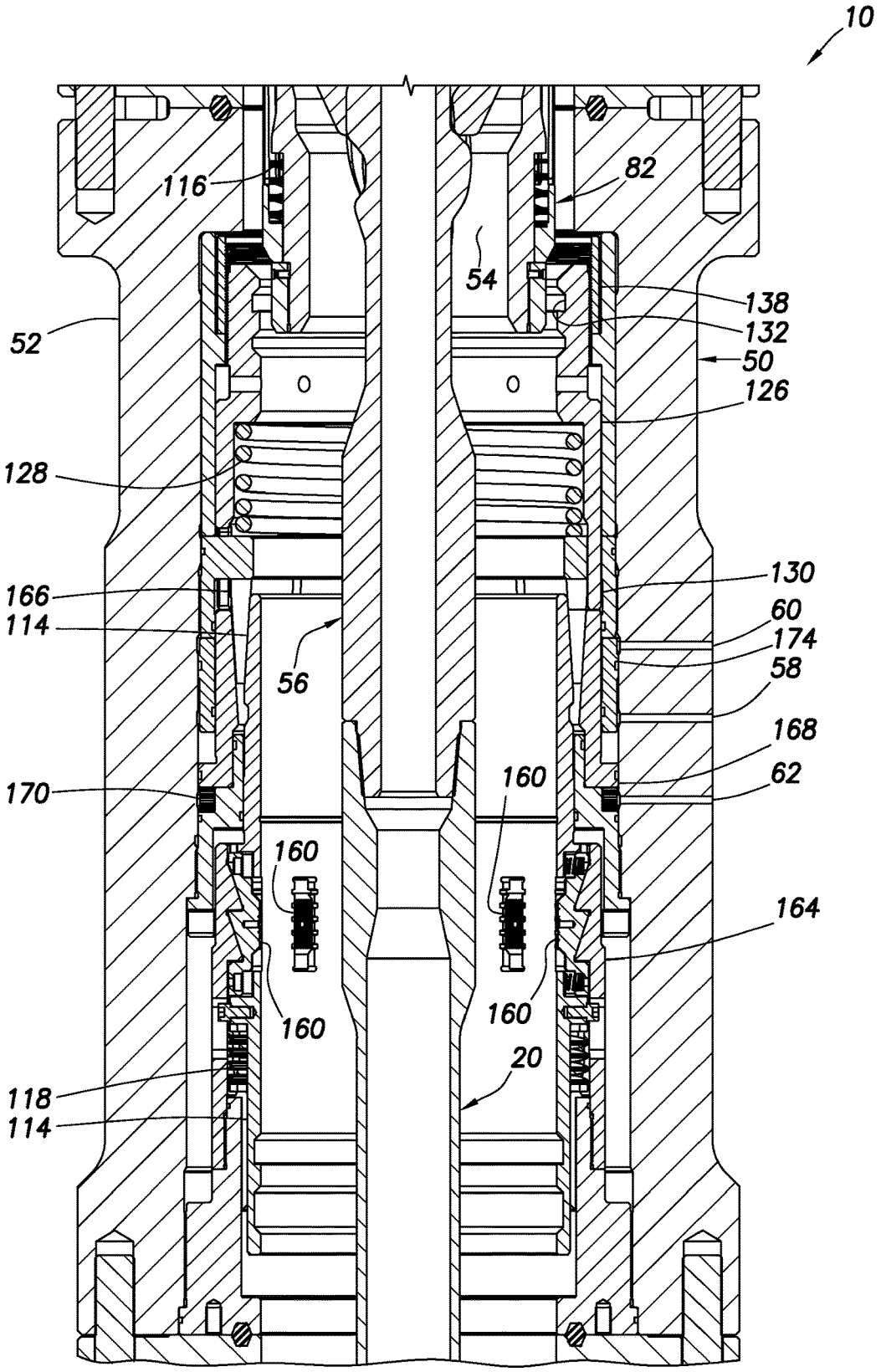

Although the lock ring 138 inhibits upward displacement of the release sleeve 126 as depicted in FIG. 29B, the release sleeve 126 can in some examples be returned to its initial position (e.g., as depicted in FIG. 7) by applying sufficient increased pressure to a port 62 formed through the outer housing 52. This increased pressure will cause an upwardly directed force to be applied by the piston 168 to the release sleeve 126 via the projections 130.

The upwardly directed force will overcome the gripping engagement between the lock ring 138 and the release sleeve 126, thereby allowing the release sleeve to be displaced upward to its initial position. The releasable assembly 40 (or another releasable assembly) can then be installed in the latch 46 and outer housing 52 of the pressure control device 50 using the running tool 56 as described above.

When the running tool 56 has retrieved the releasable assembly 40 to the surface, the releasable assembly 40 can be removed from the running tool 56 by actuating the index mechanism 144, so that the engagement members 146 are no longer supported in engagement with the internal profile 184 by the support structure 148. This actuation of the index mechanism 144 can be accomplished essentially as described above, that is, by flowing fluid through the flow passage 154 at or above a predetermined flow rate, so that a sufficient pressure differential is created across the orifice 182, and then ceasing the flow.

It may now be fully appreciated that the above disclosure provides significant advancements to the art of constructing and operating pressure control devices and running tools therefor. The above examples provide for convenient and reliable installation, operation and retrieval of components of pressure control devices, such as the releasable assembly 40.

A system 10 for use with a subterranean well is provided to the art by the above disclosure. In one example, the well system 10 can comprise: a pressure control device 50 including a releasable assembly 40, and a running tool 56 including a lock mechanism 142 that releasably secures the running tool 56 to the releasable assembly 40. The lock mechanism 142 is operable in response to a change in a fluid flow rate through the running tool 56.

The lock mechanism 142 may release the running tool 56 from the releasable assembly 40 in response to the change in the fluid flow rate. The lock mechanism 142 may secure the running tool 56 to the releasable assembly 40 in response to the change in the fluid flow rate.

The change in the fluid flow rate may include an increase in the fluid flow rate, followed by a decrease in the fluid flow rate. The running tool 56 may also include an index mechanism 144 which actuates the lock mechanism 142 between released and secured configurations in response to the change in the fluid flow rate.

The releasable assembly 40 may include at least one annular seal 42 configured to seal off an annular space between the releasable assembly 40 and a tubular string 20 disposed in a flow passage 54 extending longitudinally through the releasable assembly 40. The releasable assembly 40 may also include at least one bearing 90, 92 that permits rotation of the annular seal 42 relative to an outer housing 52 of the pressure control device 50.

A method of retrieving a releasable assembly 40 of a pressure control device 50 is also provided to the art by the above disclosure. In one example, the method can comprise engaging a running tool 56 with a latch 46 of the pressure control device 50; applying a force from the running tool 56 to the latch 46, thereby deactivating the latch 46; changing a fluid flow rate through the running tool 56, thereby securing the running tool 56 to the releasable assembly 40; and then retrieving the releasable assembly 40.

The fluid flow rate changing step can include increasing the fluid flow rate to at least a predetermined fluid flow rate, and then decreasing the fluid flow rate. The fluid flow rate changing step can include actuating a lock mechanism 142 of the running tool 56 from a released configuration to a secured configuration.

The force applying step can include displacing a setting sleeve 114 of the latch 46 to an unset position. The running tool 56 engaging step can include engaging at least one engagement member 146 of the running tool 56 with a profile 184 formed in the latch 46.

The fluid flow rate changing step can include operating an index mechanism 144 of the running tool 56. The index mechanism 144 operating step can include displacing a support structure 148 relative to at least one engagement member 146 of the running tool 56, thereby inwardly supporting the engagement member 146.

A pressure control device 50 is also described above. In one example, the pressure control device 50 can include a releasable assembly 40 having a longitudinal flow passage 54, and a latch 46 that releasably secures the releasable assembly 40 in an outer housing 52 of the pressure control device 50, the latch 46 including a piston 168 displaceable between a set position, in which the releasable assembly 40 is secured against displacement relative to the outer housing 52, and an unset position, in which the releasable assembly 40 is released for displacement relative to the outer housing 52, the piston 168 being configured to displace toward the unset position in response to fluid pressure applied to a port 58, 60 in the outer housing 52, and the piston 168 being configured to displace toward the unset position in response to displacement of a profile 132 by a running tool 56 disposed in the longitudinal flow passage 54.

The profile 132 may be formed in a release sleeve 126 longitudinally reciprocably disposed relative to the piston 168. The piston 168 may be releasably maintained in the set position by a frusto-conical setting ring 166.

The piston 168 may displace relative to the setting ring 166 in response to displacement of the profile 132. At least one slip 160 may displace out of gripping engagement with the releasable assembly 40 in response to displacement of the profile 132.

The releasable assembly 40 may include at least one annular seal 42 configured to seal off an annular space between the releasable assembly 40 and a tubular string 20 disposed in the longitudinal flow passage 54.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well system, comprising:

a pressure control device including a releasable assembly; and a running tool including a lock mechanism that releasably secures the running tool to the releasable assembly, in which a fluid is concurrently circulated in and out of the running tool via a continuous flow passage extending through the running tool, and in which the running tool further includes an index mechanism which alternately transitions between a released configuration and a secured configuration in response to an increase in a flow rate of the fluid to at least a predetermined flow rate, followed by a decrease in the flow rate of the fluid, for each transition.

2. The well system of claim 1, in which the released configuration releases the running tool from the releasable assembly.

3. The well system of claim 1, in which the secured configuration secures the running tool to the releasable assembly.

4. The well system of claim 1, in which the index mechanism actuates the lock mechanism between the released and the secured configurations.

5. The well system of claim 1, in which the releasable assembly comprises at least one annular seal configured to seal off an annular space between the releasable assembly and a tubular string disposed in a flow passage extending longitudinally through the releasable assembly.

6. The well system of claim 5, in which the releasable assembly further comprises at least one bearing that permits rotation of the annular seal relative to an outer housing of the pressure control device.

7. A method of retrieving a releasable assembly of a pressure control device, the method comprising:

conveying a running tool proximate an outer housing of the pressure control device, the outer housing including a latch which releasably secures the releasable assembly in the outer housing of the pressure control device;

engaging the running tool with the latch;

applying a force from the running tool to the latch, thereby deactivating the latch;

concurrently circulating a fluid in and out of the running tool via a continuous flow passage extending through the running tool;

changing a flow rate of the fluid, thereby securing the running tool to the releasable assembly; and then retrieving the releasable assembly.

8. The method of claim 7, in which the fluid flow rate changing comprises increasing the fluid flow rate to at least a predetermined fluid flow rate, and then decreasing the fluid flow rate.

9. The method of claim 7, in which the fluid flow rate changing comprises actuating a lock mechanism of the running tool from a released configuration to a secured configuration.

10. The method of claim 7, in which the force applying comprises displacing a setting sleeve of the latch to an unset position.

11. The method of claim 7, in which the running tool engaging comprises engaging at least one engagement member of the running tool with a profile formed in the latch.

12. The method of claim 7, in which the fluid flow rate changing comprises operating an index mechanism of the running tool.

13. The method of claim 12, in which the index mechanism operating comprises displacing a support structure relative to at least one engagement member of the running tool, thereby inwardly supporting the engagement member.

14. A pressure control device, comprising:

a releasable assembly having a longitudinal flow passage; and an outer housing including a latch that releasably secures the releasable assembly in the outer housing, the latch including a piston displaceable between a set position, in which the releasable assembly is secured against displacement relative to the outer housing, and an unset position, in which the releasable assembly is released for displacement relative to the outer housing, the piston being configured to displace toward the unset position in response to pressure applied to a port in the outer housing, and the outer housing further including a profile, the piston being configured to displace toward the unset position due to displacement of the profile in the outer housing by a running tool disposed in the longitudinal flow passage.

15. The pressure control device of claim 14, in which the profile is formed in a release sleeve longitudinally reciprocably disposed relative to the piston.

16. The pressure control device of claim 14, in which the piston is releasably maintained in the set position by a frusto-conical setting ring.

17. The pressure control device of claim 16, in which the piston displaces relative to the setting ring in response to displacement of the profile.

18. The pressure control device of claim 14, in which at least one slip displaces out of gripping engagement with the releasable assembly in response to displacement of the profile.

19. The pressure control device of claim 14, in which the releasable assembly comprises at least one annular seal configured to seal off an annular space between the releasable assembly and a tubular string disposed in the longitudinal flow passage.

* * * * *